US008776485B2

(12) United States Patent
Nishitsuji et al.

(10) Patent No.: US 8,776,485 B2
(45) Date of Patent: Jul. 15, 2014

(54) FORM-FILL-SEAL MACHINE

(75) Inventors: Satoshi Nishitsuji, Shiga (JP); Fumitaka Tokuda, Shiga (JP); Shinji Takeichi, Shiga (JP); Toshikazu Shimada, Shiga (JP); Toshiharu Kageyama, Shiga (JP); Toshikazu Shotsu, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 375 days.

(21) Appl. No.: 13/365,091

(22) Filed: Feb. 2, 2012

(65) Prior Publication Data

US 2012/0198799 A1 Aug. 9, 2012

(30) Foreign Application Priority Data

Feb. 4, 2011 (JP) ..... 2011-022943
Jul. 21, 2011 (JP) ..... 2011-159481
Nov. 14, 2011 (JP) ..... 2011-248794

(51) Int. Cl.
*B65B 9/06* (2012.01)

(52) U.S. Cl.
USPC ..... 53/551; 53/555; 53/450; 53/451

(58) Field of Classification Search
USPC ..... 53/450, 451, 551, 555
See application file for complete search history.

(56) References Cited

U.S. PATENT DOCUMENTS 3,731,451 A 5/1973 Sexstone et al.
4,391,081 A * 7/1983 Kovacs ..... 53/436
4,532,753 A * 8/1985 Kovacs ..... 53/451
4,999,974 A * 3/1991 Kovacs et al. ..... 53/434
7,779,612 B2 * 8/2010 Fergusson et al. ..... 53/451
8,356,455 B2 * 1/2013 Sato et al. ..... 53/58
2004/0154271 A1 * 8/2004 Rietjens ..... 53/451
2010/0223886 A1 * 9/2010 Sugioka et al. ..... 53/248
2010/0242416 A1 * 9/2010 Sato et al. ..... 53/494

FOREIGN PATENT DOCUMENTS

DE 102007056293 A1 5/2009
EP 0129988 A1 1/1985
JP 2002-59905 A 2/2002
JP 2007-290735 A 11/2007

OTHER PUBLICATIONS

Extended European Search Report of the corresponding European Patent Application No. 12153736.9, dated Jun. 21, 2012.

* cited by examiner

*Primary Examiner* — Hemant M Desai
(74) *Attorney, Agent, or Firm* — Global IP Counselors, LLP

(57) ABSTRACT

A form-fill-seal machine is capable of reducing poor sealing caused by a packaged article catching in lateral seal portions. The form-fill-seal machine is provided with an upper tube, a lower tube disposed therebelow, a former, a lateral sealing mechanism below the lower tube, and opening and closing sliding members. A packaged article is dropped through the interiors of the upper tube and the lower tube. The former winds a sheet of a film F around the circumference of the lower tube to convert same into a tubular film. The lateral sealing mechanism laterally seals the tubular film. The opening and closing sliding members, which are disposed between the upper tube and the lower tube, shut off an upwardly oriented flow of gas from the interior of the lower tube when in a closed state.

17 Claims, 16 Drawing Sheets

FORM-FILL-SEAL MACHINE

TECHNICAL FIELD

The present invention relates to a form-fill-seal machine, and in particular relates to a form-fill seal machine for producing a bag filled with a packaged article by laterally sealing a tubular packaging material.

BACKGROUND ART

Conventionally, there have existed form-fill-seal machines for producing bags by shaping a sheet of a packaging material into a tube and, in a state where the interior thereof has been filled with a snack food or other packaged article, laterally sealing the upper and lower end parts of the packaging material. For example, an upright form-fill-seal machine uses a shaping member or the like to shape a sheet of a packaging material into a tube, and then vertically seals both vertically overlapping edges of the tubular packaging material. During a state where a dropped packaged article is located in the interior space of the tubular packaging material, the upper and lower end parts of a portion of the tubular packaging material serving as a single bag are laterally sealed in sequence, forming a lower sealed part and an upper sealed part in a state where the packaged article is present within the tubular packaging material. To be specific, a lateral seal is made across the leading portion of the bag serving as the upper end part and the following portion of the bag serving as the lower end part, and immediately thereafter (or, alternatively, at the same time) the middle of the lateral seal portion is vertically separated by a cutter, thus forming the tubular bag material into a lower sealed part and an upper sealed part. By repeating such an operation, a form-fill-seal machine continuously produces bags filled with packaged articles.

In a case where potato chips or other articles having a low specific gravity are the packaged article with which the bag is filled, articles in a group may undergo greater vertical separation as they fall, and get caught in the lateral seal portions. Various companies have been devoted to innovations for preventing poor sealing caused by this "catching" phenomenon, such as the technology disclosed in Japanese Laid-Open Patent Application No. 2002-59905.

SUMMARY

Technical Problem

In the lateral sealing operation performed by a form-fill-seal machine, as disclosed in Japanese Laid-Open Patent Application No. 2002-59905, both heat and pressure are applied. That is, the lateral sealing operation includes an operation in which the lateral seal potions of a tubular film are tucked in. The present inventors have recently found through intensive study that during such an operation, there occurs a phenomenon in which the air present above the lateral sealing mechanism inside the tubular film flows upward as the tubular film is being squeezed. Then, particularly when a form-fill-seal operation is performed for packaged articles having a low specific gravity, such as a snack food, the upward flow of air is presumed to cause a disturbance to the state of the group of packaged articles.

It is an object of the present invention to provide a form-fill-seal machine capable of reducing poor sealing caused by a packaged article catching in the lateral seal portions.

Solution to Problem

The form-fill-seal machine according to the present invention laterally seals a tubular packaging material, whereby a bag filled with a packaged article dropped in from above is produced from the tubular packaging material. The form-fill-seal machine is provided with a first cylindrical member, a second cylindrical member, a shaping member, a lateral sealing mechanism, an opening and closing member, and a control device. The packaged article, which is discharged from a weighing machine and dropped in from above, passes through the interior of the first cylindrical member. The second cylindrical member is located below the first cylindrical member. The packaged article, having dropped through the interior of the first cylindrical member, passes through the interior of the second cylindrical member. The shaping member winds a sheet-form packaging material around the circumference of the second cylindrical member. The sheet-form packaging material is thereby changed into a tubular packaging material. The lateral sealing mechanism is located below the second cylindrical member. The lateral sealing mechanism laterally seals the tubular packaging material by forming a lower seal part and an upper seal part of the bag. The lower seal part and the upper seal part are formed in the tubular packaging material when the lateral seals are made. The opening and closing member is disposed between the first cylindrical member and the second cylindrical member. The opening and closing member, when in the closed state, is responsible for shutting off the upwardly oriented flow of air from the interior of the second cylindrical member. The control device controls movements of the lateral sealing mechanism and the opening and closing member.

Herein, the opening and closing member is deployed above the second cylindrical member which, together with the shaping member, serves to shape the sheet-form packaging material into the tubular packaging material. The opening and closing member can then shut off the upwardly oriented flow of air from the space of the interior of the second cylindrical member, i.e., the space above the lateral sealing mechanism in which the packaged article is located. When no opening and closing member is provided, an upwardly oriented flow of air is created in the interior space of the first and second cylindrical member by the lateral sealing operation, but herein such a flow can be cut off by the opening and closing member. Therefore, it is possible to prevent any disturbance to the state of the packaged article being dropped in from above, and to reduce poor sealing.

In a case where the clearance in the height direction between the first cylindrical member and the second cylindrical member is small; for example, in a case where the size of clearance is 20% or less of the inside diameter of the first cylindrical member, then it is preferable to use an opening and closing member that slides in a horizontal direction or in a substantially horizontal direction, thereby switching between an open state and the closed state.

In order for the packaged article being dropped in from above to be sent downward unimpeded, the first cylindrical member and second cylindrical member preferably have substantially equivalent inside diameters. Specifically, the inside diameter of the second cylindrical member is preferably within the range of 90% to 110% of the inside diameter of the first cylindrical member. Further, the inside diameter of the second cylindrical member is preferably slightly larger than the inside diameter of the first cylindrical member.

Preferably, the control device links the movement of the lateral sealing mechanism and the movement of the opening and closing member. Specifically, a control is preferably performed such that before the start of the forming of the upper and lower sealing parts of the bag in which heat and pressure are made to act on the tubular packaging material, the opening and closing member is moved to the closed state, and then the opening and closing member is returned to the open state at a predetermined time after the welding has been initiated.

The speed at which the package is produced and/or the manner in which each of the members are disposed, and in particular the positioning of the opening and closing member in the height direction, are preferably determined so as to give rise to the following circumstances. The circumstances are those in which, when the opening and closing member is in the closed state, a first group of packaged articles is located within a first bag provided with an upper seal part; a second group of packaged articles that follows the first packaged articles is located on the inside of a tubular packaging material provided with a lower seal part above the first bag; and a third group of packaged articles that follows the second packaged articles is located in the interior of the first cylindrical body above the opening and closing member.

It is further preferable that when the opening and closing member is in the closed state, the opening at the top end of the second cylindrical member is blocked such that substantially none of the air within the second cylindrical member leaks out from the opening at the top end. In such a case, the packaged articles being dropped in through the second cylindrical member are better prevented from becoming disarrayed.

It is further effective to deploy a sealing member between the second cylindrical member and the opening and closing member. The packaged articles being dropped in through the second cylindrical member are further prevented from becoming disarrayed when the sealing member can be used to prevent the gaseous material of the interior space of the second cylindrical member from leaking outward from the clearance in the height direction between the top end of the second cylindrical member and the opening and closing member when the opening and closing member is in the closed state. The deployment of the sealing member can adequately prevent gaseous material from leaking outward from the clearance provided that the clearance in the height direction between the upper end of the second cylindrical member and the opening and closing member is 1.0 mm or less.

It is further preferable to design the second cylindrical member or other similar structure such that an air-discharging passage is formed between the outer surface of the second cylindrical member and the tubular packaging material that has been wound around the circumference of the second cylindrical member. The air-discharging passage extends from a position as high as the lower part of the second cylindrical member upward to a position above the shaping member, whereby gaseous material can escape to the space outside and above the tubular packaging material from the interior space of the tubular packaging material. In such a case, the air in the space can escape outward from the air-discharging passage even though the lateral sealing causes the space in the circumference around the packaged articles to have a greater pressure.

To ensure the air-discharging passage, it is preferable to form, on the second cylindrical member, an inwardly recessed groove that extends from the lower part thereof to a position above the shaping member. In such a case, the space between the depressed surface of the groove and the tubular packaging material will function as the air-discharging passage.

Further, to prevent the packaged articles from becoming oxidized, it is preferable to provide a first gas supply unit for supplying an inert gas to the interior space of the second cylindrical member from the vicinity of the opening and closing member. In such a case, when the inert gas (such as nitrogen gas or argon gas) is supplied from the first gas supply unit while the opening and closing member is in the closed state, then a flow of inert gas following the dropping of the packaged articles being dropped in through the second cylindrical member can be generated, and it also becomes possible to increase the packaging speed.

In a case where, in addition to the first gas supply unit, there is further provided a second gas supply unit for supplying inert gas to the interior space of the tubular packaging material from the vicinity of the lower part of the second cylindrical material, it is preferable that the first gas supply unit be used to supply the inert gas to the interior space of the second cylindrical member when the opening and closing member is in the closed state. In a case where the first gas supply unit is used to supply the inert gas when the opening and closing member is in the closed state and the second gas supply unit is used to supply the inert gas when the opening and closing member is in the open state, there is the potential to achieve a favorable balance between an adequate amount of inert gas being supplied and the generation of the flow of inert gas following the dropping of the packaged articles.

Further, instead of the first gas supply unit and the second gas supply unit, it is also effective to supply the inert gas by providing the following third gas supply unit and fourth gas supply unit. The third gas supply unit is intended to supply inert gas to the interior space of the tubular packaging material, and the fourth gas supply unit is intended to supply inert gas to the interior space of the first cylindrical member when the opening and closing member is in the closed state. In such a case, inert gas will be supplied to the packaged articles while the opening and closing member is in the closed state and the packaged articles remain within the first cylindrical member. In so doing, much of the air in the space around the circumference of the packaged articles and between each of the packaged articles is replaced with inert gas, and the packaged articles will be adequately prevented from becoming oxidized even when the amount of inert gas supplied thereafter from the third gas supply unit is reduced.

The form-fill-seal machine according to the present invention may be further provided with a suction device for performing a suction operation. The suction operation of the suction device is an operation for allowing gaseous material to escape outside the tubular packaging material from the interior space of the tubular packaging material that has been wound around the circumference of the second cylindrical member. In a case where the suction device is provided, it is also preferable that the control device link the movement of the lateral sealing mechanism and the suction operation of the suction device, and cause the suction device to perform the suction operation immediately before initiation of the welding performed by the lateral sealing mechanism using heat and pressure on the tubular packaging material to form at least one of the upper and lower sealing parts of the bag. When such a control is performed, the suction device can be used to prevent the operation of the lateral sealing from creating an upwardly oriented flow of air in the interior spaces of the first and second cylindrical members even in a case such as where the opening and closing member cannot be used to cut off the same or where the closing operation of the opening and closing member is delayed.

In a form-fill-seal machine that is further provided with a suction device, then immediately before the start of welding in which the lateral sealing mechanism applies heat and pressure on the tubular packaging material to form at least one of the upper and lower sealing parts, the control device preferably sends out an instruction causing the opening and closing member to transition from the open state to the closed state, and causes the suction device to perform the suction operation. By the act of the suction operation, the creation of an upwardly oriented flow of air within the second cylindrical member can be prevented even when, before the opening and closing member can be closed, there is a change in the volume of the tubular packaging material when the welding of the lateral sealing mechanism is initiated.

In a form-fill-seal machine that is further provided with a suction device, there may be further deployed a gas supply unit for supplying inert gas to the interior space of the tubular packaging material from a vicinity of the lower part of the second cylindrical member. In such a case, the interior space of the second cylindrical member is divided into a primary space into which the packaged articles are dropped and a secondary space partitioned from the primary space, it being possible to use the secondary space as a suction flow path for gaseous material during the suction operation of the suction device and also to use same as a supply flow path for inert gas from a gas supply unit.

Advantageous Effects of Invention

According to the present invention, the upwardly oriented flow of air that would be created in the interior space of the first cylindrical member by the lateral sealing operation when no opening and closing member is provided can be prevented by closing the opening and closing member, and also poor sealing can be reduced.

DESCRIPTION OF EMBODIMENTS

First Embodiment

Summary

Figure 1:
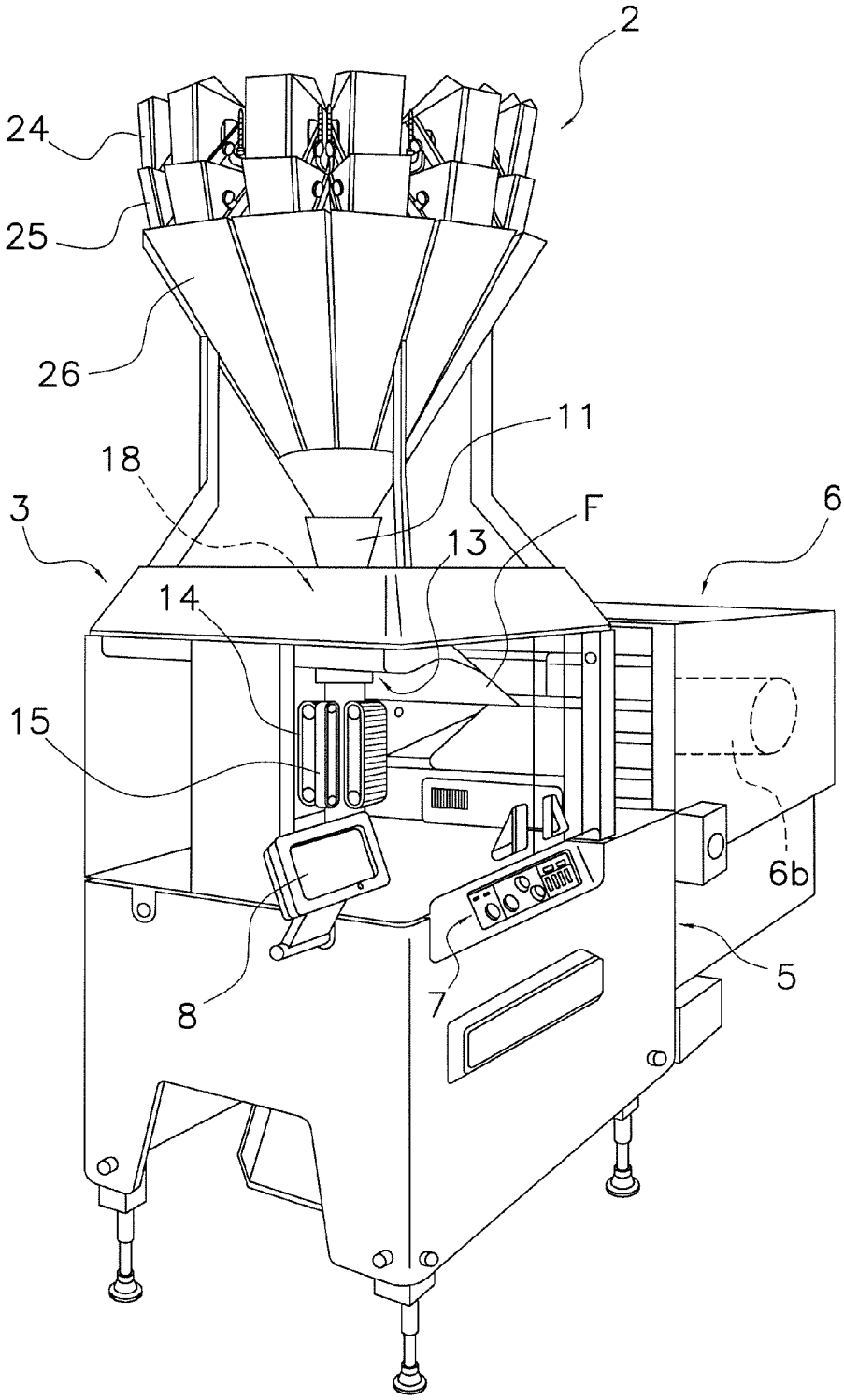
FIG. 1 is a schematic perspective view of a weighing machine and the form-fill-seal machine according to an embodiment of the present invention (a first embodiment).

FIG. 1 is an illustration of an upright form-fill-seal machine 3 according to one embodiment of the present invention, as well as a weighing machine 2 disposed thereabove. The form-fill-seal machine 3 is a machine for producing a bag by using a film to cover potato chips or another food product having a low apparent specific gravity, serving as packaged articles, and then vertically and laterally sealing the film that has been imparted with a tubular shape.

The packaged articles are dropped in by predetermined amounts from the weighing machine 2 above the form-fill-seal machine 3. The weighing machine 2 is a combination weighing device comprising a feeder, a pool hopper 24, a weighing hopper 25, an aggregate discharge chute 26, and other elements.

Figure 2:
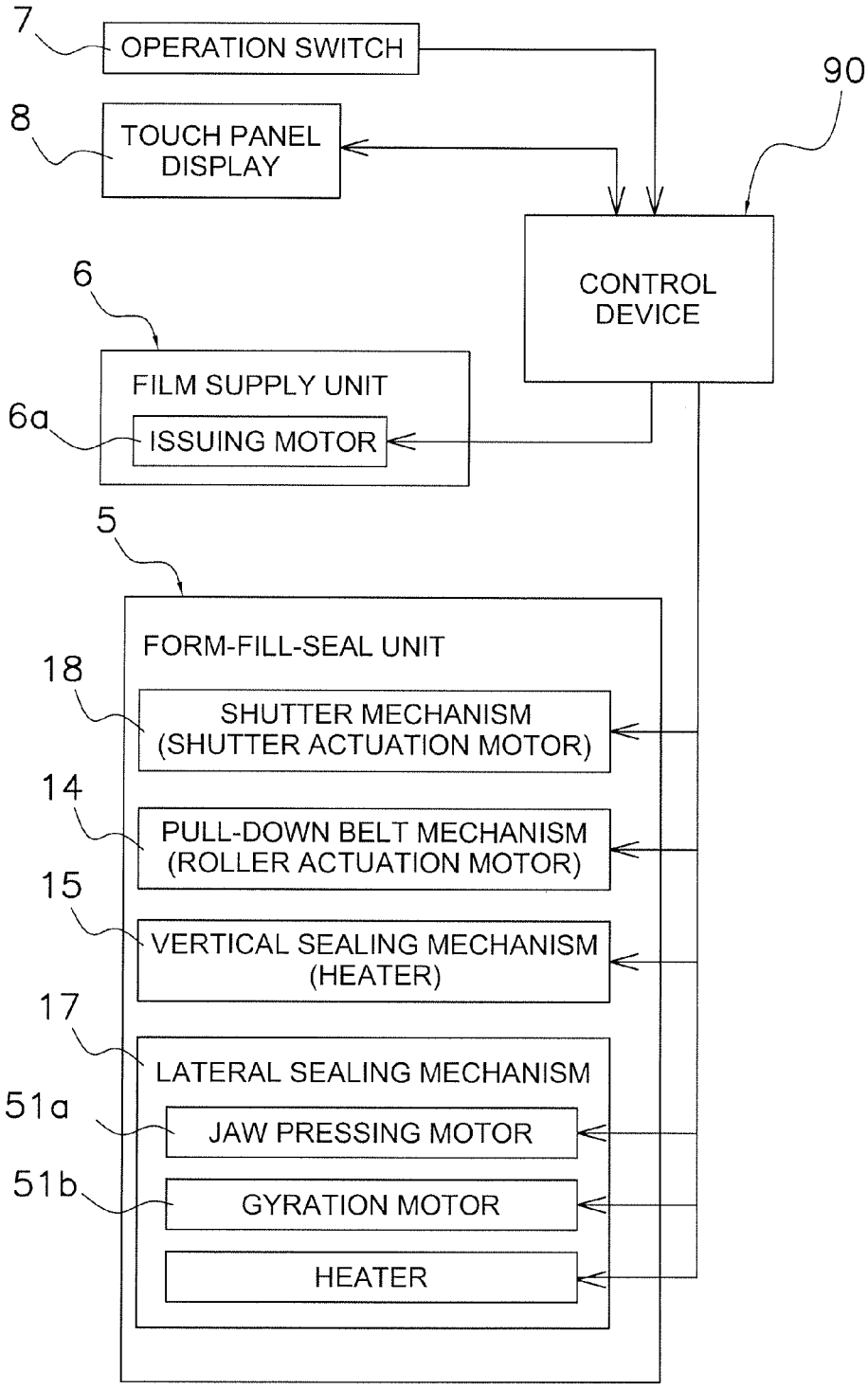
FIG. 2 is a block diagram representing the control of the form-fill-seal machine.

The form-fill-seal machine 3 includes a form-fill-seal unit 5, which is a body portion for bagging the packaged articles (see FIG. 3); a film supply unit 6 for supplying the form-fill-seal unit 5 with a film F to be made into a bag; and a control device 90 for controlling the movement of the actuated portions of both units 5, 6 (see FIG. 2).

The Film Supply Unit

The film supply unit 6 is a unit for supplying a shaping mechanism 13 of the form-fill-seal unit 5 with a sheet of the film F, and is provided adjacent to the form-fill-seal unit 5. A film roll **6*b* around which the film F is wound is positioned in the film supply unit 6, and the film F is reeled out from the film roll 6*b***.

The film F reeled out from the film roll **6*b* is conveyed by being dispensed by the operation of a dispensing motor 6*a* for causing the film roll 6*b* to rotate (see FIG. 2), and is then stretched out toward the form-fill-seal unit 5 by the operation of a pull-down belt mechanism 14 of the form-fill-seal unit 5, to be described later. The movements of the dispensing motor 6*a* and the pull-down belt mechanism 14 are controlled by the control device 90**.

The Form-Fill-Seal Unit

Figure 3:
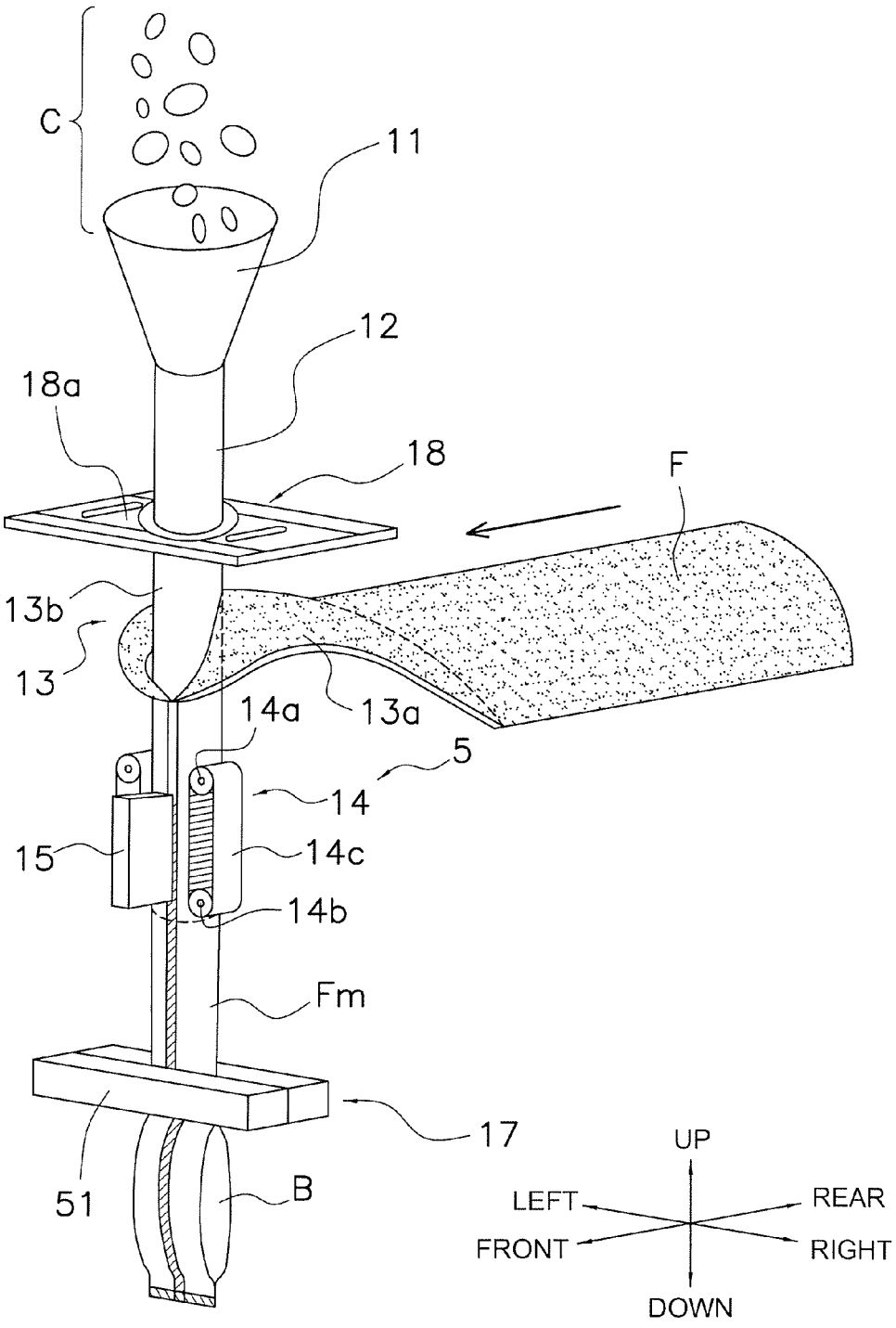
FIG. 3 is a schematic perspective view of the main parts of the form-fill-seal machine.
Figure 4:
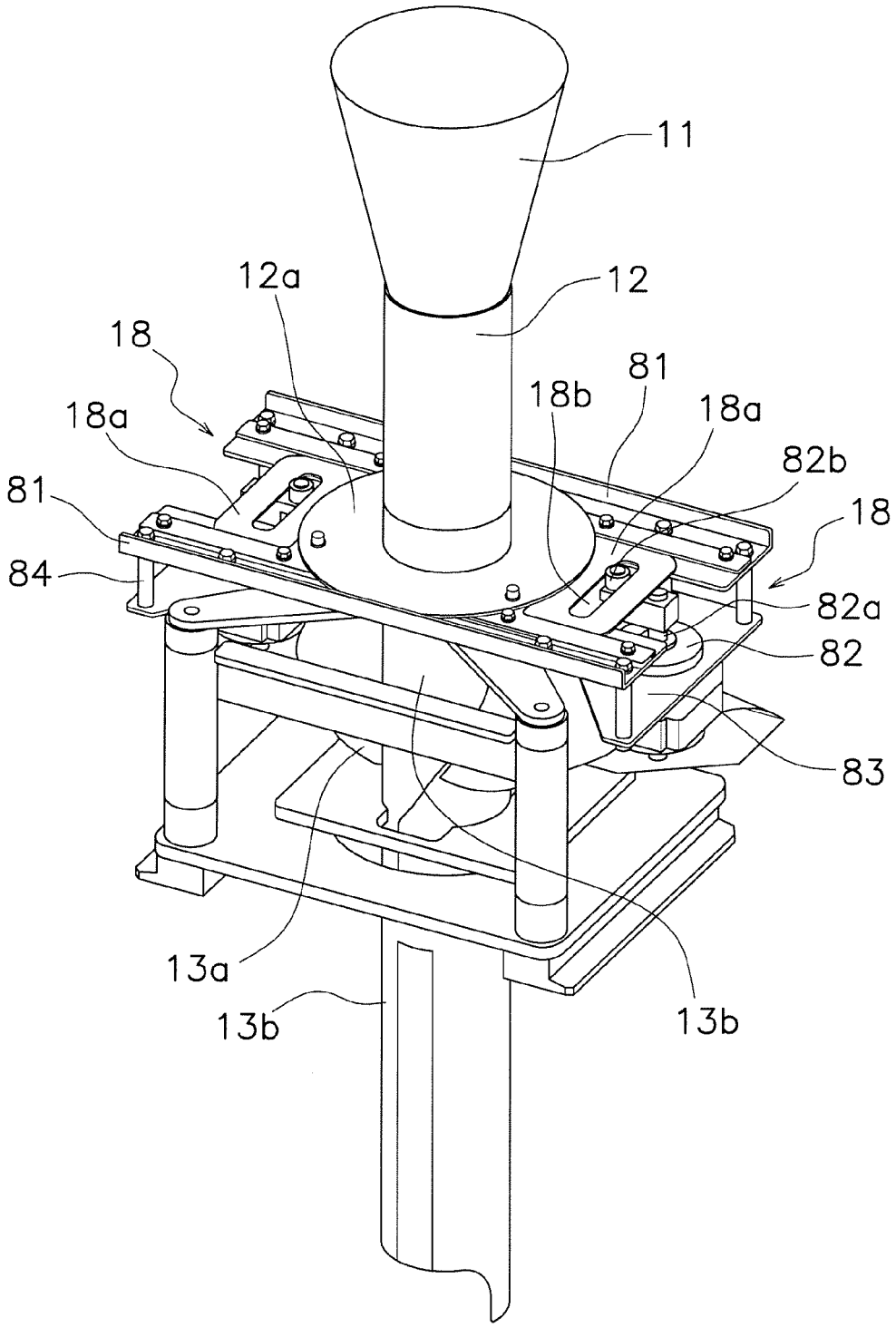
FIG. 4 is a perspective view of a funnel member, an upper tube, a shutter mechanism, and a shaping mechanism.
Figure 5:
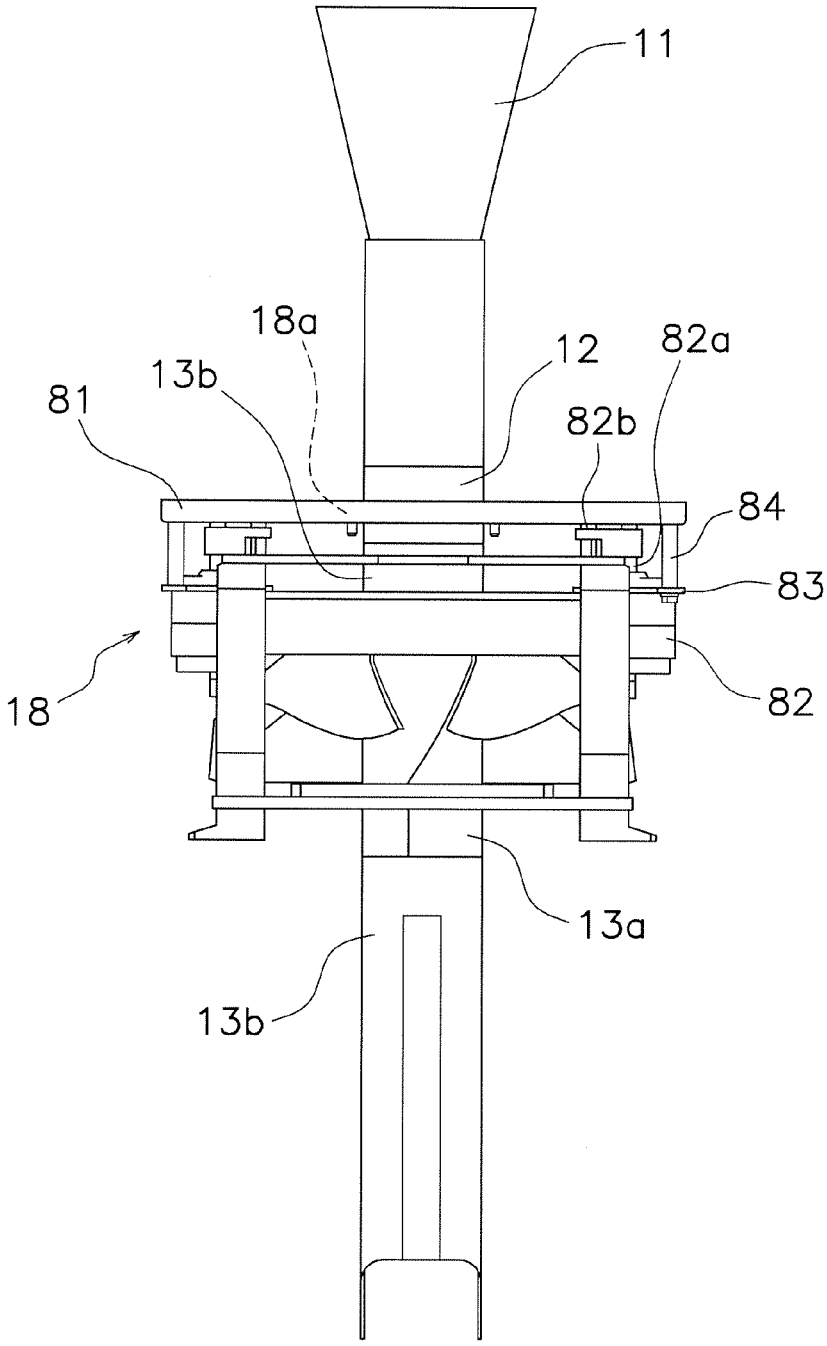
FIG. 5 is a front view of a funnel member, an upper tube, a shutter mechanism, and a shaping mechanism.
Figure 6:
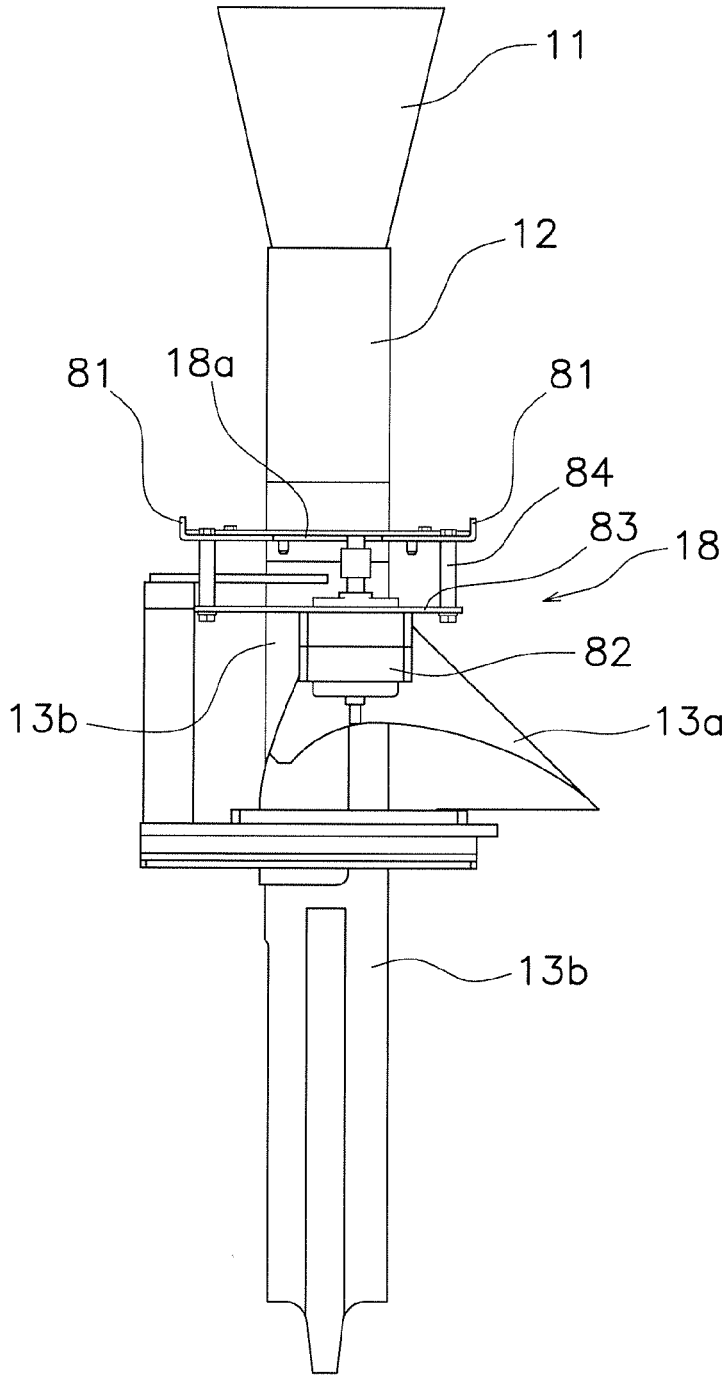
FIG. 6 is a side view of a funnel member, an upper tube, a shutter mechanism, and a shaping mechanism.

The form-fill-seal unit 5, as illustrated in FIG. 3, has the shaping mechanism 13 for shaping the film F, which is issued in a sheet, into a tube; the pull-down belt mechanism 14 for downwardly conveying the film F that has taken a tubular shape (hereinafter called the tubular film Fm); a vertical sealing mechanism 15 for vertically sealing the overlapping portions of both edges of the tubular film Fm; and a lateral sealing mechanism 17 for heat-sealing the upper and lower end parts of a bag B by laterally sealing the tubular film Fm. The form-fill-seal unit 5 further has a funnel member 11 and an upper tube 12, which, together with a lower tube **13*b* of the shaping mechanism 13, act as a route for the packaged articles; and a shutter mechanism 18 provided directly above the shaping mechanism 13**.

The Funnel Member 11

Figure 7:
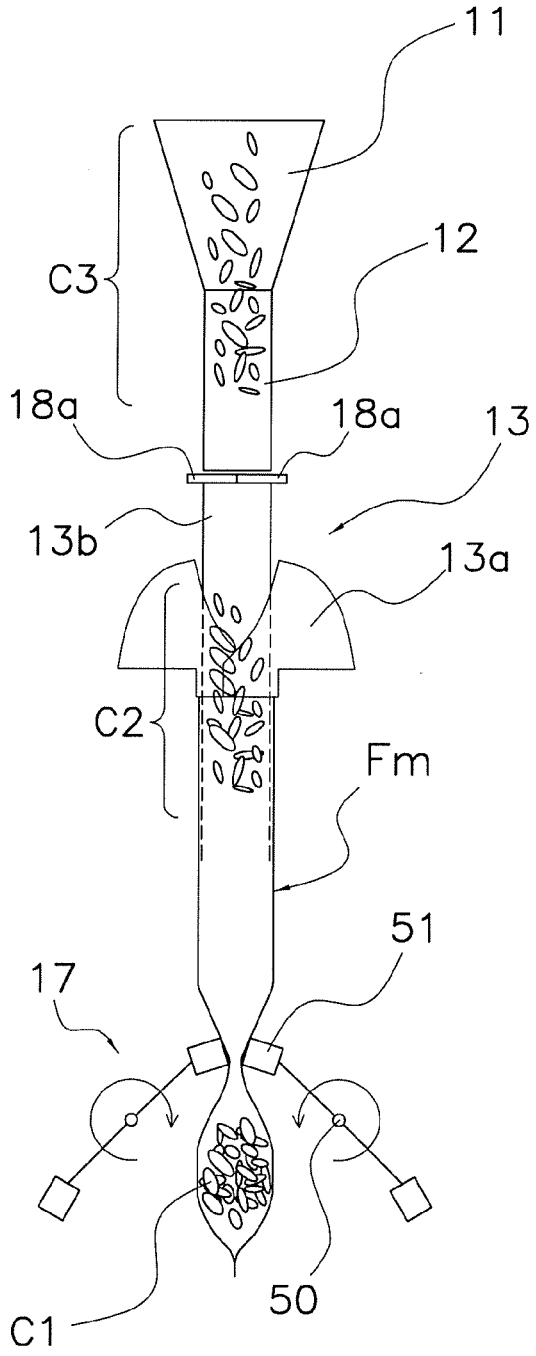
FIG. 7 is a drawing illustrating the state in which the packaged articles have been dropped in during the initial stage of the welding of the lateral sealing operation.

The funnel member 11 is a tubular member in which the diameter of the round opening at the upper part has a greater diameter than the diameter of the round opening at the lower part, and receives, from the opening at the upper part, the packaged articles C weighed by the weighing machine 2 and dropped in from a middle opening of the aggregate discharge chute 26. The packaged articles C placed therein from the opening at the upper part of the funnel member 11, as illustrated in FIG. 7, are dropped from the opening at the lower part into the interior space of the upper tube 12 therebelow.

The Upper Tube 12

The packaged articles C discharged from the weighing machine 2, guided into the funnel member 11, and dropped in from above continue falling through the interior of the upper tube 12. The upper tube 12 is a cylindrical member, the upper end thereof being connected to the lower end of the funnel member 11. That is, the round opening at the lower part of the funnel member 11 is matched to the opening at the upper part of the cylindrical upper tube 12.

A circular flange member 12*a* is affixed to the lower end part of the upper tube 12 at which the opening at the lower part of the upper tube 12 is formed. The flange member 12*a* is mounted and affixed to a fixed frame 81 of the shutter mechanism 18, to be described later, whereby the upper tube 12 and the funnel member 11 are positioned. The upper tube 12, which extends in the vertical direction, has a round opening at the lower part thereof, the center of which is matched to the center of the round opening at the upper end of a lower tube 13*b* of the shaping mechanism 13, to be described later.

The Shaping Mechanism 13

The shaping mechanism 13 has the lower tube 13*b* and a former 13*a*. The lower tube 13*b* is a round-shaped member, the upper and lower ends of which are open. When opening and closing sliding members 18*a* of the shutter mechanism 18 (described below) are in a closed state, the round opening at the upper end of the lower tube 13*b* is blocked by the opening and closing sliding members 18*a*. The lower tube 13*b* is disposed so as to have a small clearance opening below the above-described upper tube 12; when the opening and closing sliding members 18*a* are in an open state, then the packaged articles C that have been dropped through the interior of the upper tube 12 continue falling uninterrupted through the interior of the lower tube 13*b*.

The former 13*a* is disposed so as to surround the lower tube 13*b*. The former 13*a* shapes a sheet of the film F so as to be wound around the circumference of the lower tube 13*b* (see FIG. 3 and FIGS. 4 to 6). The sheet of the film F reeled out from the film roller 6*b* is therefore shaped into a tube upon passing between the former 13*a* and the lower tube 13*b*; the upper surface of the film F becomes an inner peripheral surface of the tubular film Fm, and the lower surface of the film F becomes an outer peripheral surface of the tubular film Fm.

As described above, a clearance in the height direction is present between the upper tube 12 and the lower tube 13*b*, the structure being such that the opening and closing sliding members 18*a* (described below) enter into the clearance. To prevent the manner in which the packaged articles C are dropped from being disturbed, the size of the clearance is preferably 20% or less the size of the inside diameter of the upper tube 12 (80 mm). Herein, the sheet thickness of the opening and closing sliding members 18*a* is about 1.5 mm; therefore, the size of the clearance is then 2 mm to 10 mm.

The upper tube 12 and the lower tube 13*b* have substantially equivalent inside diameters. Herein, the upper tube 12 is given an inside diameter of 80 mm, and the lower tube 13*b* is given an inside diameter of 84 mm, which is slightly larger than the upper tube. The upper tube 12 and the lower tube 13*b* are disposed such that the centers of the respective round cross-sections form a matching plane; the packaged articles C dropped in through the upper tube 12 thus fall unimpeded into the interior space of the lower tube 13*b* without getting stuck at any point.

The former 13*a* and the lower tube 13*b* of the shaping mechanism 13 can be mutually exchanged depending on the size of the bag to be produced. If mutually exchanged, it is preferable that the upper tube 12 and the funnel member 11 thereabove also be mutually exchanged in accordance therewith.

The Pull-Down Belt Mechanism 14

The pull-down belt mechanism 14 is a mechanism for chucking and downwardly conveying the tubular film Fm that has been wound around the lower tube 13*b*, and, as illustrated in FIG. 3, has belts 14*c* provided to each of the left and right sides thereof across the lower tube 13*b*. In the pull-down belt mechanism 14, the belts 14*c*, which function so as to chuck, are turned by a drive roller 14*a* and a driven roller 14*b*, thus bearing the tubular film Fm downward. However, FIG. 3 omits an illustration of a roller actuation motor, which causes the drive roller 14*a* and the like to rotate.

The Vertical Sealing Mechanism 15

The vertical sealing mechanism 15 is a mechanism for vertically sealing the overlapping portions of the tubular film Fm having been wound around the lower tube 13*b*, using heating while pressing down on the lower tube 13*b* with a predetermined amount of pressure. The vertical sealing mechanism 15 is positioned at the front side of the lower tube 13*b* and has a heater, as well as a heater belt, which is heated by the heater and is in contact with the overlapping portions of the tubular film Fm. The vertical sealing mechanism 15 is also provided with an actuation device (not shown) adapted to bring the heater belt closer to or away from the lower tube 13*b*.

The Lateral Sealing Mechanism 17

The lateral sealing mechanism 17 is disposed below the shaping mechanism 13, the pull-down belt mechanism 14, and the vertical sealing mechanism 15. The lateral sealing mechanism 17 is a mechanism that includes a pair of sealing jaws 51 having a built-in heater (see FIG. 3).

Figure 8:
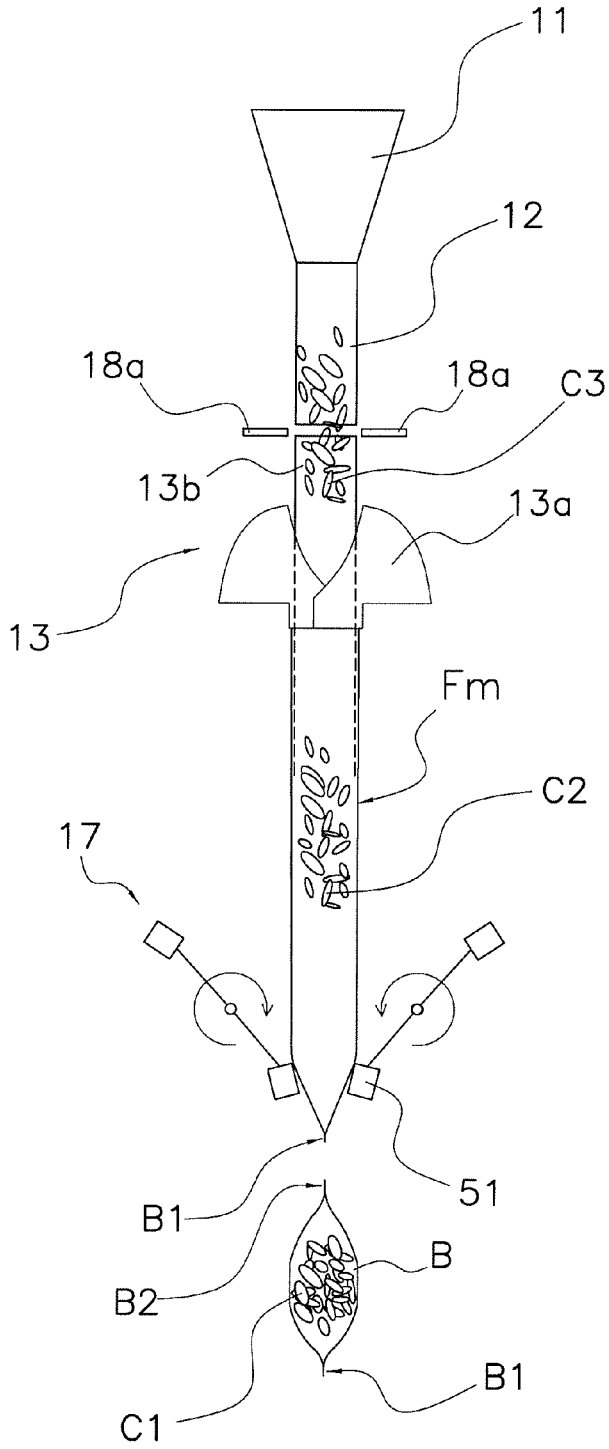
FIG. 8 is a drawing illustrating the state in which the packaged articles have been dropped in after the welding of the lateral sealing operation has been completed.

The pair of sealing jaws 51 gyrates in a substantially D-shaped manner while tracing mutually symmetrical trajectories. The actuation mechanism used for the gyrating movement is, for example, the invention disclosed in the publication of JP-A 10-53206, and is provided with a jaw-pushing motor 51*a* and a gyrating motor 51*b*, which are illustrated in FIG. 2. The pair of sealing jaws 51 that gyrates in a substantially D-shaped manner clasp the tubular film Fm in a state of being mutually pushed together, where (lateral) sealing is performed by the application of pressure and heat to the portion of the tubular film Fm that is to become the upper and lower end parts of the bag. In addition, a cutter (not shown) is built into one of the sealing jaws 51. The cutter is responsible for separating the bag B from the tubular film Fm that follows, at a central position in the height direction of the portion laterally sealed by the sealing jaws 51. As illustrated in FIG. 8, a lower sealing part B1 and an upper sealing part B2 are formed, by the lateral sealing, on the bag B and the tubular film Fm that follows.

During the process in which the pair of sealing jaws 51 make initial contact with the tubular film Fm and the film Fm is then laterally sealed by pressure and heat in an overlapped state, there presumably occurs the phenomenon in which air appears to escape from the interior space of the tubular film Fm as the volume in the tubular film Fm decreases.

The Shutter Mechanism 18

The shutter mechanism 18 is a structure composed of the opening and closing sliding members 18*a*, which are positioned in the clearance in the height direction between the upper tube 12 and the lower tube 13*b*; and various parts adapted to guide or actuate the opening and closing sliding members 18*a*. The shutter mechanism 18 is provided with the pair of sheet-shaped opening and closing sliding members

18*a*; two motors 82; a bearing 82*b* that is eccentric with respect to rotating shafts 82*a* of the motors 82; the fixed frames 81; a motor support platform 83; and fixed pillars 84.

The pair of opening and closing sliding members 18*a* are thin sheet-shaped members having a sheet thickness of 1.5 mm, as described above; are guided and supported on the front and rear fixed frames 81; and are capable of left and right horizontal movement (sliding). As illustrated in FIG. 7, the state in which the pair of opening and closing sliding members 18*a* bump up against each other is the closed state, and, as illustrated in FIG. 8, the state in which both of the opening and closing sliding members 18*a* have withdrawn from the upper space of the lower tube 13*b* is the open state. In the closed state, the round opening at the upper end of the lower tube 13*b* is blocked, and almost no clearance remains between the upper end of the lower tube 13*b* and the opening and closing sliding members 18*a*. That is, in the closed state, the opening and closing sliding members 18*a* are responsible for shutting off the upwardly oriented flow of air from the interior of the lower tube 13*b*. The opening and closing sliding members 18*a* have elliptical openings 18*b* formed at the left and right outer portions. The elliptical openings 18*b* extend in the front-rear direction. The bearings 82*b* enter into the elliptical openings 18*b* from below, there being contact between the inner peripheral surfaces of the elliptical openings 18*b* and the outer rings of the bearings 82*b*.

The bearings 82*b* have an outer ring and an inner ring, and the inner ring is affixed to the rotating shafts 82*a* of the motors 82. The inner rings of the bearings 82*b* are eccentric with respect to the rotating shafts 82*a* of the motors 82, and the bearings 82*b* gyrate around the rotating shafts 82*a* of the motors 82. The gyration of the bearings 82*b* alternates between the closed state and the open state of the opening and closing sliding members 18*a*.

The main bodies of the motors 82 are affixed to the motor support platform 83. The motor support platform 83 and the fixed frames 81 are integrated together by the four fixed pillars 84. The fixed frames 81 are affixed to the frame of the form-fill-seal machine 3. The fixed frames 81 provide support such that the opening and closing sliding members 18*a* can be slid to the left or right, and the upper surfaces thereof serve as surfaces onto which the flange member 12*a* to which the upper tube 12 is affixed is installed. The flange member 12*a* is mounted onto the front and rear fixed frames 81, and is screwed into the fixed frames 81.

However, FIG. 3 omits an illustration of the shutter actuation motors 82 for actuating the opening and closing sliding members 18*a*, as well as of other elements.

The Control Device

The control device 90 controls the weighing machine 2 and the form-fill-seal machine 3, and comprises a CPU, a ROM, a RAM, and the like. The control device 90 controls the actuated portions and the like of each of the mechanism of the film supply unit 6 and the form-fill-seal unit 5, in accordance with an operation and/or setting inputted from an operation switch 7 and/or a touch panel display 8 illustrated in FIGS. 1 and 2. The control device 90 further controls the actuation of the feeder, the pull hopper 24, the weighing hopper 25, and other elements of the weighing machine 2. The control device 90 further takes required information from various different sensors located on the weighing machine 2 and the form-fill-seal machine 3, and uses the information in various different controls.

The control device 90 is also tasked with controlling the pull-down belt mechanism 14, the vertical sealing mechanism 15, and the lateral sealing mechanism 17 of the form-fill-seal unit 5, as well as the motors 82 of the shutter mechanism 18. The controls of each of the mechanisms 14, 15, 17, 18 are linked. The description herein focuses on the linked controls of the lateral sealing mechanism 17 and the shutter mechanism 18.

FIG. 7 is a drawing illustrating the timing by which the opening and closing sliding members 18*a* of the shutter mechanism 18 enter the closed state and, immediately thereafter, the pair of sealing jaws 51 of the lateral sealing mechanism 17 first come into contact with the tubular film Fm. At such a time, a first group of packaged articles C1 is located within a first bag B (see FIG. 8) provided with an upper seal part B2 illustrated in FIG. 8; a second group of packaged articles C2 that follows the first packaged articles C1 is located on the inside of the tubular film Fm on which a lower seal part B1 (see B1 on FIG. 8) will be formed above the first bag B; and a third group of packaged articles C3 that follows the second packaged articles C2 is located in the interior of the upper tube 12 above the opening and closing sliding members 18*a*. The pair of sealing jaws 51 come into contact with the tubular film Fm for the first time, and the tubular film Fm is squeezed mainly at the laterally sealed portions, wherefore the pressure in the space around the circumference of the packaged articles C2 increases. Herein, because the opening and closing sliding members 18*a* are in the closed state, almost no upward airflow caused by the operation of the welding of the lateral sealing will occur in either the space around the circumference of the packaged articles C2 or the space around the circumference of the packaged articles C3, and the states of the packaged articles C2, C3 are less prone to being disturbed. Conversely, when the opening and closing sliding members 18*a* are in the open state in the timing of FIG. 7, an upward airflow toward the interior space of the upper tube 12 is created from the interior space of the lower tube 13*b*, and the airflow disturbs the orientations of the packaged articles C2, C3, increasing the frequency by which the packaged articles get caught in the sealed portions when the packaged articles C2, C3 are laterally sealed; however, because herein the opening and closing sliding members 18*a* are in the closed state, poor sealing is prevented.

When the tubular film Fm is squeezed mainly at the portions being laterally sealed and the pressure in the space around the circumference of the packaged articles C2 increases, air presumably escapes outward through the circular clearance between the tubular film Fm and the lower tube 13*b* or through other clearances.

The control device 90 brings the opening and closing sliding members 18*a* into the closed state before the time illustrated in FIG. 7 at which the sealing jaws 51 first come into contact with the tubular film Fm, but during circumstances where the pair of sealing jaws 51 mutually press together across the overlapping portions of the tubular film Fm, i.e., when welding by pressure and heat is initiated, the opening and closing sliding members 18*a* are thereafter returned to the open state at an appropriate time. The third packaged articles C3 are thereby dropped downward unimpeded. As in FIG. 8, the opening and closing sliding members 18*a* enter the opened state at such a time when the upper sealing part B2 of the leading bag B and the lower sealing part B1 of the following tubular film Fm have been completely laterally sealed (welded) and are cut apart and the sealing jaws 51 are separated from the tubular film Fm. At such a time, the sealing jaws have completed the operation meant to narrow the space inside the tubular film Fm, and even though the opening and closing sliding members 18*a* are in the open state, the orientations of the packaged articles C2, C3 will presumably not be disturbed by any airflow.

Features of the Form-Fill-Seal Machine

In the form-fill-seal machine 3 according to this embodiment, which is adapted to produce a bag B filled with the dropped-from-above packaged articles C by laterally sealing the tubular film Fm, the opening and closing sliding members 18*a* are deployed above the lower tube 13*b* of the shaping mechanism 13. The opening and closing sliding members 18*a* are capable of shutting off the upwardly oriented flow of air from the space of the interior of the lower tube 13*b*, i.e., the space above the lateral sealing mechanism 17 in which the packaged articles C are located. If the opening and closing members 18*a* are not provided, an upwardly oriented flow of air is created in the interior spaces of the lower tube 13*b* and/or the upper tube 12 by the lateral sealing operation, but in the form-fill-sealing machine 3, such a flow can almost be cut off by the opening and closing sliding members 18*a* (see FIG. 7). Therefore, the states (orientations) of the packaged articles C2, C3 dropped in from above can be prevented from being disturbed, reducing poor sealing.

The following is an illustration of specific testing results.

Embodiments

Testing Conditions

Samples (packaged articles): Potato chips (bulk density of 0.083 grams per square centimeter when placed in a container and shaken to reduce the clearance between the articles as much as possible)

Target weight of the weighing machine 2: 31.9 grams to 34.9 grams

Abilities: 150 bpm (150 bags/min) at continuous bag production

Bag size: 140 mm wide, 203 mm high, 37 mm thick

Weighing machine and form-fill-seal machine used

Weighing machine: CCW-R-214W made by Ishida Co., Ltd.

Form-fill-seal machine: a device made by adding the shutter mechanism 18 and the like to an ATLAS made by Ishida Co., Ltd.

Testing Summary and Evaluation Criteria

The proportion at which the potato chips caught in the laterally sealed portions (the number of bags in which catching occurred, divided by the total number of bags made) and the length of time needed for an entire group of potato chips to enter the tubular film serving as the bag (the maximum length of time in the sampled bags) were evaluated for instances when the present invention is not adopted, where the opening and closing sliding members 18*a* are always in the open state, and instances when the present invention is adopted, where the opening and closing sliding members 18*a* are opened and closed by the control routine of the embodiment described above.

Testing Results

In the case where the present invention was not adopted, catching occurred in 12 bags out of 100 bags, equating to a catching proportion of 12%; in the case where the present invention was adopted, no catching occurred in any of the bags of the 100 bags, equating to a catching proportion of 0%.

Regarding the length of time needed for an entire group of potato chips to enter the tubular film serving as the bag (hereinafter called the charge time), in the case where the present invention was not adopted, the longest time it took among the 50 sampled bags was 499 ms, and in the case where the present invention was adopted, the longest time it took among the 50 sampled bags was 366 ms.

More specifically, the case where the present invention was adopted bore excellent results in both of the evaluation criteria, which were the catching proportion and the charge time.

Second Embodiment

Figure 9:
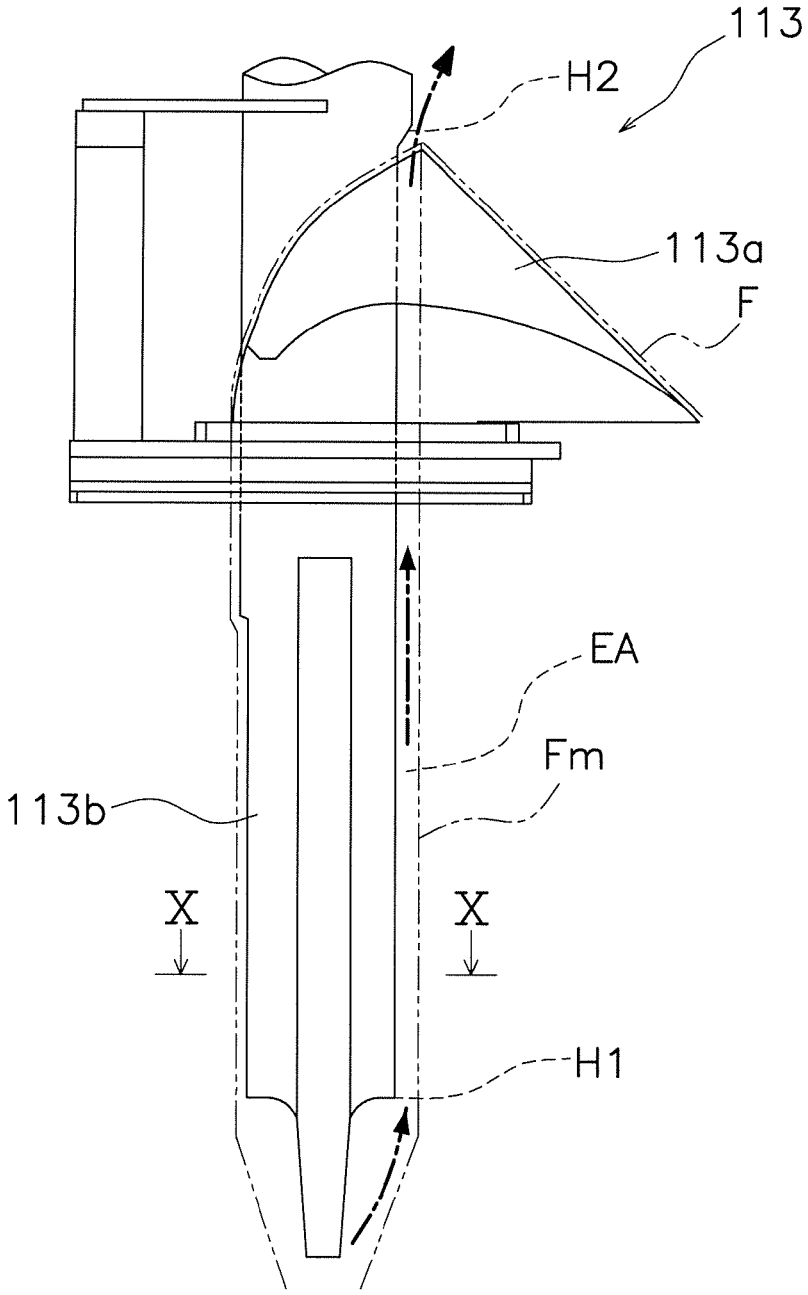
FIG. 9 is a side view of a shaping mechanism of a form-fill-seal machine according to a second embodiment.
Figure 10:
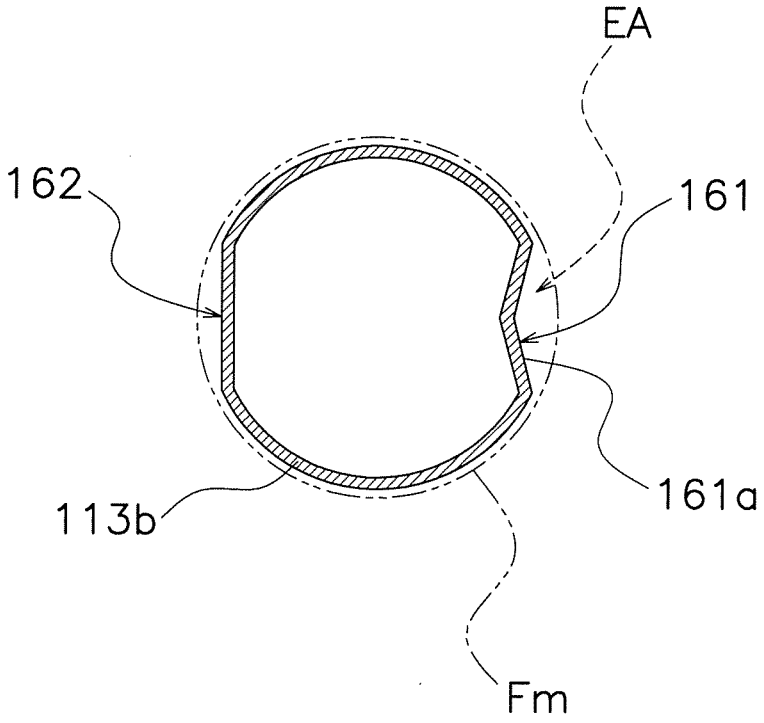
FIG. 10 is a cross-sectional view along the X-X line of FIG. 9.

The first embodiment described above is configured such that when the tubular film Fm is squeezed mainly at the portion being laterally sealed, and the pressure in the space around the circumference of the packaged articles C2 increases, air escapes outward through the circular clearance between the tubular film Fm and the lower tube 13*b*, but in the second embodiment, a lower tube 113*b* illustrated in FIGS. 9 and 10 is used to proactively increase the surface area of the passage through which the air escapes.

In the form-fill-seal machine according to the second embodiment, the shaping mechanism 13 of the form-fill-seal machine according to the first embodiment is replaced by a shaping mechanism 113 illustrated in FIGS. 9 and 10; the configuration thereof is otherwise similar to that of the first embodiment.

The Shaping Mechanism 113

The shaping mechanism 113 has a former 113*a* and a lower tube 113*b*.

The former 113*a* is disposed so as to surround the lower tube 113*b*, and has the same shape as the former 13*a* described above. A sheet of the film F is shaped into a tube upon passing between the former 113*a* and the lower tube 113*b*; the upper surface of the film F becomes an inner peripheral surface of the tubular film Fm, and the lower surface of the film F becomes an outer peripheral surface of the tubular film Fm.

The lower tube 113*b* is a substantially round-shaped member, the upper and lower ends of which are open. When the opening and closing sliding members 18*a* of the shutter mechanism 18 are in a closed state, the round opening at the upper end of the lower tube 113*b* is blocked by the opening and closing sliding members 18*a*. As illustrated in FIG. 10, a groove 161 is formed on a side surface on the rear surface of the lower tube 113*b*, and a flat part 162 is formed on a side surface on the front surface of the lower tube 113*b*. The groove 161 is formed by inwardly depressing a part of the rear surface of a round-shaped member, and, as illustrated in FIG. 9, extends upward from a position H1 as high as the lower end of a side surface of the rear surface of the lower tube 113*b* up until a position H2 that is higher than a position as high as the former 113*a*. In the state in which the tubular film Fm has been wound around the lower tube 113*b*, as illustrated in FIG. 10, an air-discharging passage EA is formed between the tubular film Fm and a depressed surface 161*a* of the groove 161 of the lower tube 113*b*. The air-discharging passage EA allows the gaseous material in the interior space of the tubular film Fm to escape to the space outside and above the tubular film Fm (see the flow of gaseous material illustrated by the arrows of the single-dotted lines in FIG. 9).

The shaping mechanism 113 being so configured, the cross-sectional area of the air-discharging passage EA is adequately ensured, and therefore in the form-fill-seal machine according to the second embodiment, even though the lateral sealing causes the pressure in the space around the circumference of the packaged articles to increase, the air in the space can be reliably allowed to escape outward from the air-discharging passage EA.

Modification Example of the Second Embodiment

In the lower tube 113*b* described above, the groove 161 is provided to ensure the cross-sectional area of the air-discharging passage EA, but in place of the groove 161, a flat part that is similar to the flat part 162 illustrated in FIG. 10 can also be formed. An air-discharging passage is also formed in such a case, between the flat part of the rear surface and the tubular film Fm, the cross-sectional area thereof being large but not as large as when the groove 161 is formed.

Figure 11:
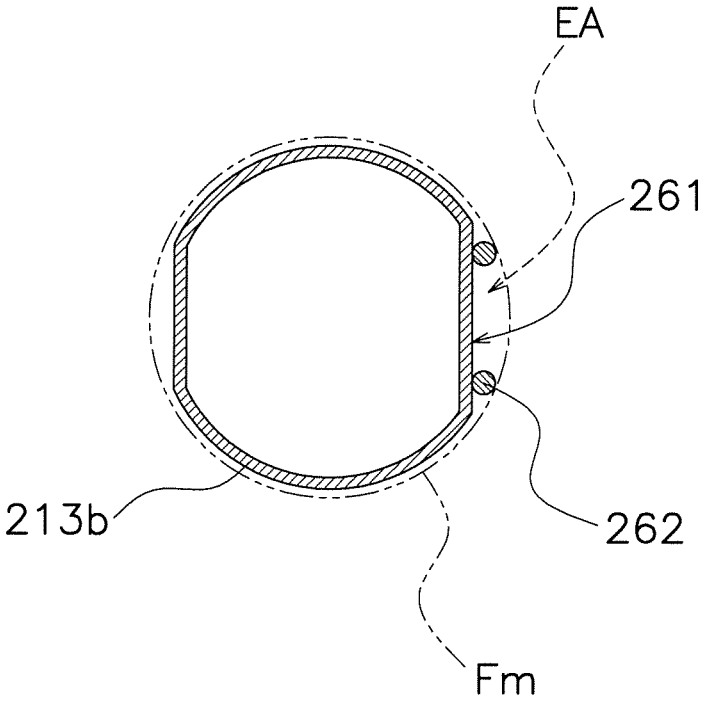
FIG. 11 is a transverse cross-sectional view of a lower tube of a modification example of the second embodiment.

Further, instead of the above-described lower tube 113*b*, it is also possible to employ a lower tube 213*b* having a cross-section, illustrated in FIG. 11. The lower tube 213*b* has a flat part 261 formed on a side surface of the rear surface, and round bar members 262, 262 extending far up and down are welded to the left and right end parts of the flat part. When such a lower tube 213*b* is employed, there appears a space surrounded by the outer surface of the flat part 261, the outer peripheral surfaces of the round bar members 262, 262, and the tubular film Fm, the space then serving as the air-discharging passage EA.

Third Embodiment

The first embodiment described above provides a description of a form-fill-seal machine having no function for supplying nitrogen gas, argon gas, or other inert gas into the tubular film Fm, but a form-fill-seal machine according to a third embodiment is intended to make a bag by laterally sealing in a state in which the air inside the tubular film Fm has been replaced with an inert gas, in order to prevent the packaged articles from becoming oxidized or degenerating.

Figure 12:
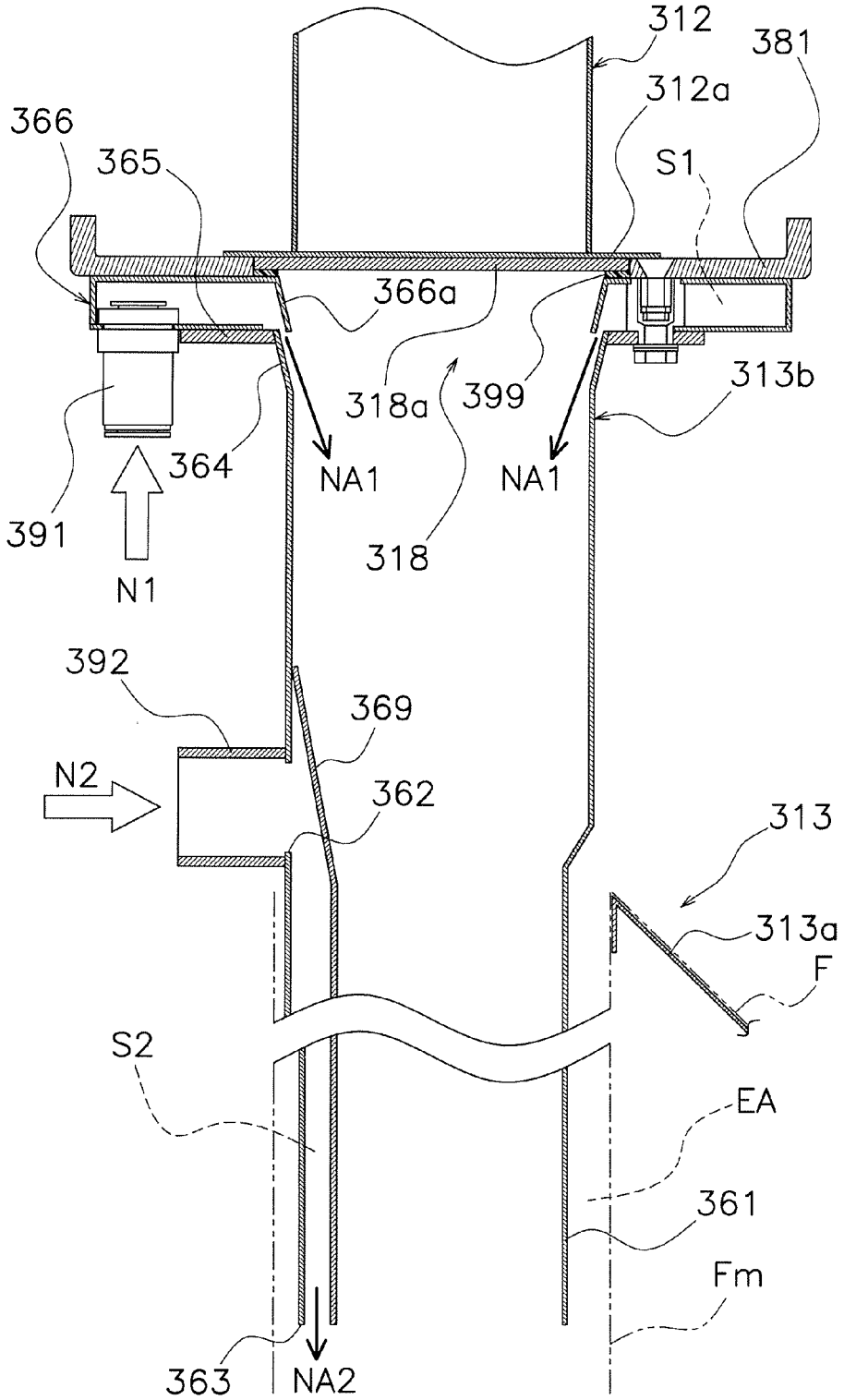
FIG. 12 is a drawing illustrating a shaping mechanism and nitrogen supply mechanism of a form-fill-seal machine according to a third embodiment.

Instead of the shaping mechanism 13 and the shutter mechanism 18 of the form-fill-seal machine according to the first embodiment, the form-fill-seal machine according to the third embodiment employs a shaping mechanism 313 and a shutter mechanism 318, illustrated in FIG. 12; the configuration thereof is otherwise similar to that of the first embodiment. The form-fill-seal machine according to the third embodiment further has a separately provided nitrogen gas supply device (not shown), from which nitrogen gas is supplied, and nitrogen gas piping connection joints 391, 392, to be described later, from which nitrogen gas is supplied to the interior space of the lower tube 313*b* and the interior space of the tubular film Fm.

The Shaping Mechanism 313

The shaping mechanism 313 has a former 313*a* and a lower tube 313*b*. The former 313*a* is disposed so as to surround the lower tube 313*b*, and has the same shape as the former 13*a* described above. A sheet of the film F is shaped into a tube upon being passed between the former 313*a* and the lower tube 313*b*, and becomes the tubular film Fm.

The lower tube 313*b* is a substantially round member, the upper and lower ends of which are open. The upper part of the lower tube 313*b* comprises a hollow circular member 366 provided with an opening at the upper end; a different-diameter pipe part 364 positioned immediately below the hollow circular member 366; and a flange member 365. The different-diameter pipe part 364, as illustrated in FIG. 12, has a greater diameter at the upper end than the diameter at the lower end. The inner peripheral edge of the flange member 365 is welded to the upper end of the different-diameter pipe part 364. A portion 366*a* forming the inner peripheral surface of the hollow circular member 366 has a greater diameter at the upper end than the diameter at the lower end, and has substantially the same shape as the different-diameter pipe part 364 (see FIG. 12). The hollow circular member 366 has a circular opening at the inner peripheral portion of the lower surface thereof. In a state of being affixed onto the flange member 365, the opening of the hollow circular member 366 downwardly directs the nitrogen gas in the interior space of the hollow circular member 366 (described later) (see the arrows NA1 in FIG. 12). The nitrogen gas piping connection joint 391 is mounted onto the outer peripheral portion of the lower surface of the hollow circular member 366. The nitrogen gas piping connection joint 391 is connected to nitrogen gas piping that extends from the nitrogen gas supply device. The interior space of the hollow circular member 366 acts as a nitrogen gas upper supply route S1 adapted to supply nitrogen gas to the interior space of the lower tube 313*b*, and nitrogen gas N1 (see FIG. 12) flows in via the nitrogen gas piping connection joint 391.

When opening and closing sliding members 318*a* of the shutter mechanism 318 are in the closed state, the opening at the upper end of the hollow circular member 366 of the lower tube 313*b* is blocked by the opening and closing sliding members 318*a*.

In addition, as illustrated in FIG. 12, a groove 361 is formed on a side surface of the rear surface of the lower tube 313*b*. The groove 361 is formed by inwardly depressing a part of the rear surface of a round-shaped member, and extends upward from a position as high as a lower end 363 of a side surface of the rear surface of the lower tube 313*b* up until a position that is higher than a position as high as the former 313*a*. In the state in which the tubular film Fm has been wound around the lower tube 313*b*, as illustrated in FIG. 12, the air-discharging passage EA is formed between the tubular film Fm and a depressed surface of the groove 361 of the lower tube 313*b*. The air-discharging passage EA allows the gaseous material in the interior space of the tubular film Fm to escape to the space outside and above the tubular film Fm.

A nitrogen gas lower supply route S2 is formed at the lower end 363 of a side surface of the front surface of the lower tube 313*b*, from a position slightly lower than the upper part of the lower tube 313*b*. The nitrogen gas lower supply route S2 is formed by a sheet member 369. Nitrogen gas N2 (see FIG. 12) is supplied to the upper part of the nitrogen gas lower supply route S2 via the nitrogen gas piping connection joint 392 and a round hole 362. The nitrogen gas piping connection joint 392 is connected to nitrogen gas piping that extends from the nitrogen gas supply device. The nitrogen gas supplied to the nitrogen gas lower supply route S2 via the nitrogen gas piping connection joint 392 sprays from an opening at the lower part of the nitrogen gas lower supply route S2 into the interior space of the tubular film Fm (see the arrow NA2 in FIG. 12).

The Shutter Mechanism 318

The shutter mechanism 318 is a mechanism composed of the opening and closing sliding members 318*a*, which are positioned in the clearance in the height direction between the upper tube 312 and the lower tube 313*b*; and various parts adapted to guide or actuate the pair of sheet-shaped opening and closing sliding members 318*a*. The opening and closing sliding members 318*a* are guided and supported on fixed frames 381 of the shutter mechanism 318, and are capable of left and right horizontal movement (in the direction orthogonal to the plane in FIG. 12). In the closed state of the opening and closing sliding members 318*a*, the round opening at the upper end of the hollow circular member 366 of the lower tube 313*b* is blocked, and almost no clearance remains between the upper end of the hollow circular member 366 of the lower tube 313*b* and the opening and closing sliding members 318*a*. To reduce the size of the clearance, the third embodiment deploys a packing 399 between the upper end of the hollow circular member 366 of the lower tube 313*b* and the opening and closing sliding members 318*a*. The packing 399 is a sealing member opened by a round opening having the same size as the round opening at the upper end of the hollow circular member 366 of the lower tube 313*b*. The opening and closing sliding members 318*a*, which slide in a horizontal direction, slide while riding on the upper surface of the packing 399. Because the packing 399 is deployed in this manner, the clearance in the height direction between the upper end of the hollow circular member 366 of the lower tube 313*b* and the opening and closing sliding members 318*a*, while still comparatively large, becomes 0.3 mm or less. A flange member 312*a* of the upper tube 312 resting on and affixed to the fixed frame 381 from above is positioned directly above the opening and closing sliding members 318*a*. The structure of the upper tube 312 is similar to the upper tube 12 of the first embodiment.

The various parts of the shutter mechanism 318 adapted to guide and actuate the opening and closing sliding members 318*a* are similar to those of the shutter mechanism 18 of the first embodiment, and therefore herein a description thereof has been omitted.

The Control Device

The control device has a similar configuration to that of the control device 90 of the first embodiment, and further controls the supply of the nitrogen gas N1 to the nitrogen gas upper supply route S1 via the nitrogen gas piping connection joint 391 as well as the supply of nitrogen gas N2 to the nitrogen gas lower supply route S2 via the nitrogen gas piping connection joint 392, by opening and closing an opening and closing valve provided to the nitrogen gas piping connected to the nitrogen gas piping connection joint 391 and an opening and closing valve provided to the nitrogen gas piping connected to the nitrogen gas piping connection joint 392. The control device controls the opening and closing operation of the opening and closing valves for nitrogen gas by linking the same to the opening and closing operation of the opening and closing sliding members 318*a* of the shutter mechanism 318.

Figure 13:
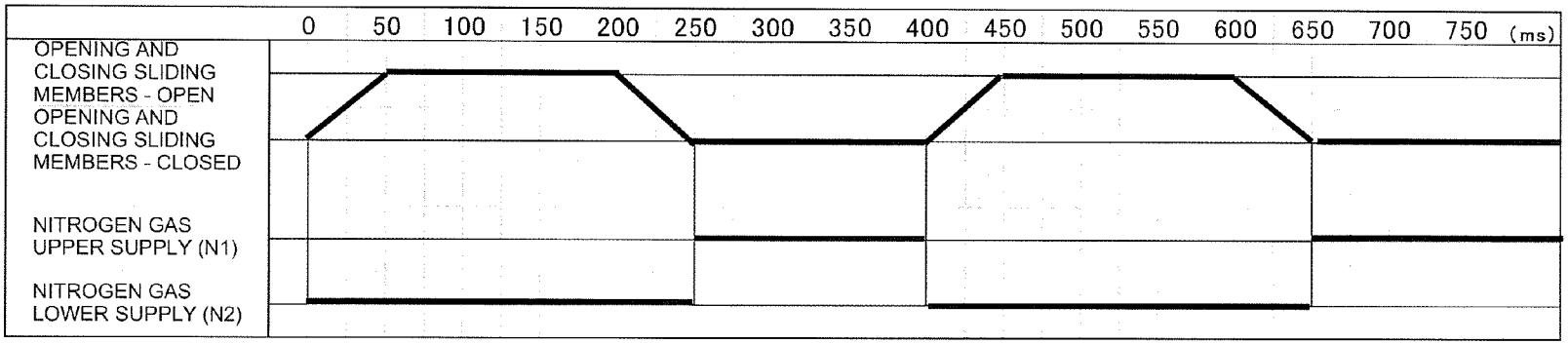
FIG. 13 is a timing chart of the nitrogen supply and of the opening and closing of an opening and closing sliding member of the third embodiment.

FIG. 13 illustrates a timing chart for the command to open and the command to close the opening and closing sliding members 318*a* as well as the supply of the nitrogen gas N1 (which in the drawing is called the upper nitrogen gas supply) and the supply of the nitrogen gas N2 (which in the drawing is called the lower nitrogen gas supply). The timing chart is one in which 150 bags are made per minute and the cycle to make one bag is 400 msec (0.4 seconds) long. Basically, when the opening and closing sliding members 318*a* are in the open state, the nitrogen gas is sprayed into the interior space of the tubular film Fm from the vicinity of the lower end 363 of the lower tube 313*b* via the nitrogen gas lower supply route S2 (see the arrow NA2 in FIG. 12), and when the opening and closing sliding members 318*a* are in the closed state, the nitrogen gas is sprayed into the interior space of the lower tube 313*b* from the vicinity of the opening and closing sliding members 318*a* via the nitrogen gas upper supply route S1 (see the arrow NA1 in FIG. 12).

Features of the Form-Fill-Seal Machine According to the Third Embodiment

Herein, when the opening and closing sliding members 318*a* are in the closed state, the opening at the upper end of the lower tube 313*b* is blocked by the opening and closing sliding members 318*a* and by the packing 399, and almost none of the gaseous material in the lower tube 313*b* will leak out from the opening at the upper end of the lower tube 313*b*. Therefore, the packaged articles being dropped through the lower tube 313*b* will be less disturbed.

Further, when the opening and closing sliding members 318*a* are in the closed state, nitrogen gas is sprayed downward from the nitrogen gas upper supply route S1 deployed in the vicinity of the opening and closing sliding members 318*a* toward the interior space of the lower tube 313*b* (see the arrow NA1 in FIG. 12). It is thereby possible to generate a flow of nitrogen gas following the dropping of the packaged articles being dropped through the interior space of the lower tube 313*b*, and to increase the speed at which bags are made.

By contrast, when the opening and closing sliding members 318*a* are in the open state, the control is such that the nitrogen gas is sprayed into the interior space of the tubular film Fm from the vicinity of the lower end of the lower tube 313*b* via the nitrogen gas lower supply route S2, wherefore a favorable balance is achieved between supplying an adequate amount of nitrogen gas and generating a flow of nitrogen gas following the dropping of the packaged articles.

Fourth Embodiment

Figure 14:
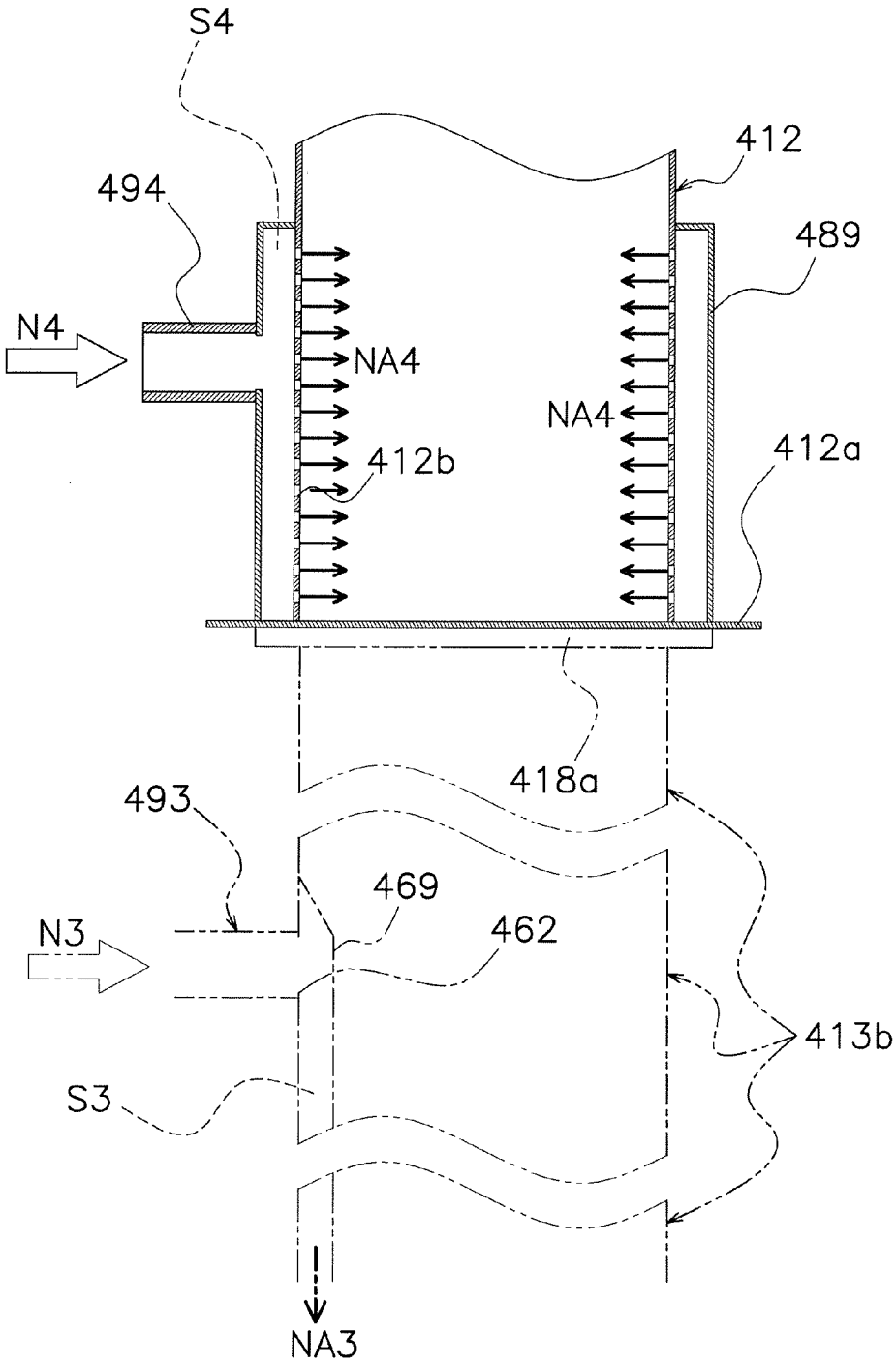
FIG. 14 is a drawing illustrating a nitrogen supply passage of a form-fill-seal machine according to a fourth embodiment.

In the form-fill-seal machine according to the third embodiment, the nitrogen gas piping connection joints 391, 392 are provided to two points of the lower tube 313*b*, but instead of such a configuration, the form-fill-seal machine according to the fourth embodiment adopts the configuration illustrated in FIG. 14.

Instead of the lower tube 13*b* of the shaping mechanism 13 and the upper tube 12 of the form-fill-seal machine according to the first embodiment, the form-fill-seal machine according to the fourth embodiment employs an upper tube 412 and a lower tube 413*b*, which are illustrated in FIG. 14.

The Upper Tube 412

The upper tube 412 is a round member, at the lower part of which several holes 412*b* open. The several holes 412*b* are provided in a plurality of rows along the peripheral surface, and are also provided in a plurality of tiers in the height direction. The circumference of the lower part of the upper tube 412 on which the holes 412*b* are formed is surrounded by a tubular member 489 having a larger inside diameter than the outside diameter of the upper tube 412. A tubular space covered by the outer peripheral surface of the tubular part of the upper tube 412, by the upper surface of a circular flange member 412*a* extending outward from the lower end of the tubular part, and by the inner surface of the tubular member 489 is partitioned from the exterior space and acts as a nitrogen gas upper supply route S4 adapted to spray nitrogen gas into the interior space of the tubular part of the upper tube 412. Nitrogen gas N4 (see FIG. 14) flows into the nitrogen gas upper supply route S4 via a nitrogen gas piping connection joint 494 fitted to the tubular member 489. The nitrogen gas piping connection joint 494 is connected to nitrogen gas piping extending from the nitrogen gas supply device. Below the circular flange member 412*a*, there are located opening and closing sliding members 418*a* of the shutter mechanism. The shutter mechanism is similar to the shutter mechanism 18 of the first embodiment, and therefore a description herein has been omitted.

The Lower Tube 413*b*

The lower tube 413*b* has a nitrogen gas lower supply route S3 formed at the lower end of the lower tube 413*b* from a position slightly lower than the upper part thereof. The nitrogen gas lower supply route S3 is formed by a sheet member 469. The upper part of the nitrogen gas lower supply route S3 is supplied with nitrogen gas N3 (see FIG. 14) via the nitrogen gas piping connection joint 493 and via a round hole 462. The nitrogen gas supply connection joint 493 is connected to nitrogen gas piping extending from the nitrogen gas supply device. The nitrogen gas supplied to the nitrogen gas lower supply route S3 via the nitrogen gas piping connection joint 493 is sprayed into the interior space of the tubular film from an opening at the lower part of the nitrogen gas lower supply route S3 (see the arrow NA3 in FIG. 14).

(Features of the Form-Fill-Seal Machine According to the Fourth Embodiment)

Herein, when the opening and closing sliding members 418*a* are in the closed state, nitrogen gas is sprayed into the inner space of the tubular part of the upper tube 412 from the nitrogen gas upper supply route S4, which is positioned above the opening and closing sliding members 418*a* (see the arrow NA4 in FIG. 14). Nitrogen gas is thereby brought to the potato chips or other packaged articles, which are in a state of remaining above the opening and closing sliding members 418*a*, and the air between the packaged articles is thereby replaced with nitrogen gas. Thereafter, the opening and closing sliding members 418*a* enter the open state and the packaged articles are dropped into the interior space of the lower tube 413*b* in a substantially aggregated state; however, the interior space of the lower tube 413*b* being then filled with the nitrogen gas supplied from the nitrogen gas lower supply route S3, the gaseous material in the space between the packaged articles in an aggregated state is also substantially replaced with nitrogen gas, wherefore the packaged articles are adequately prevented from becoming oxidized or from degenerating.

Fifth Embodiment

Figure 15:
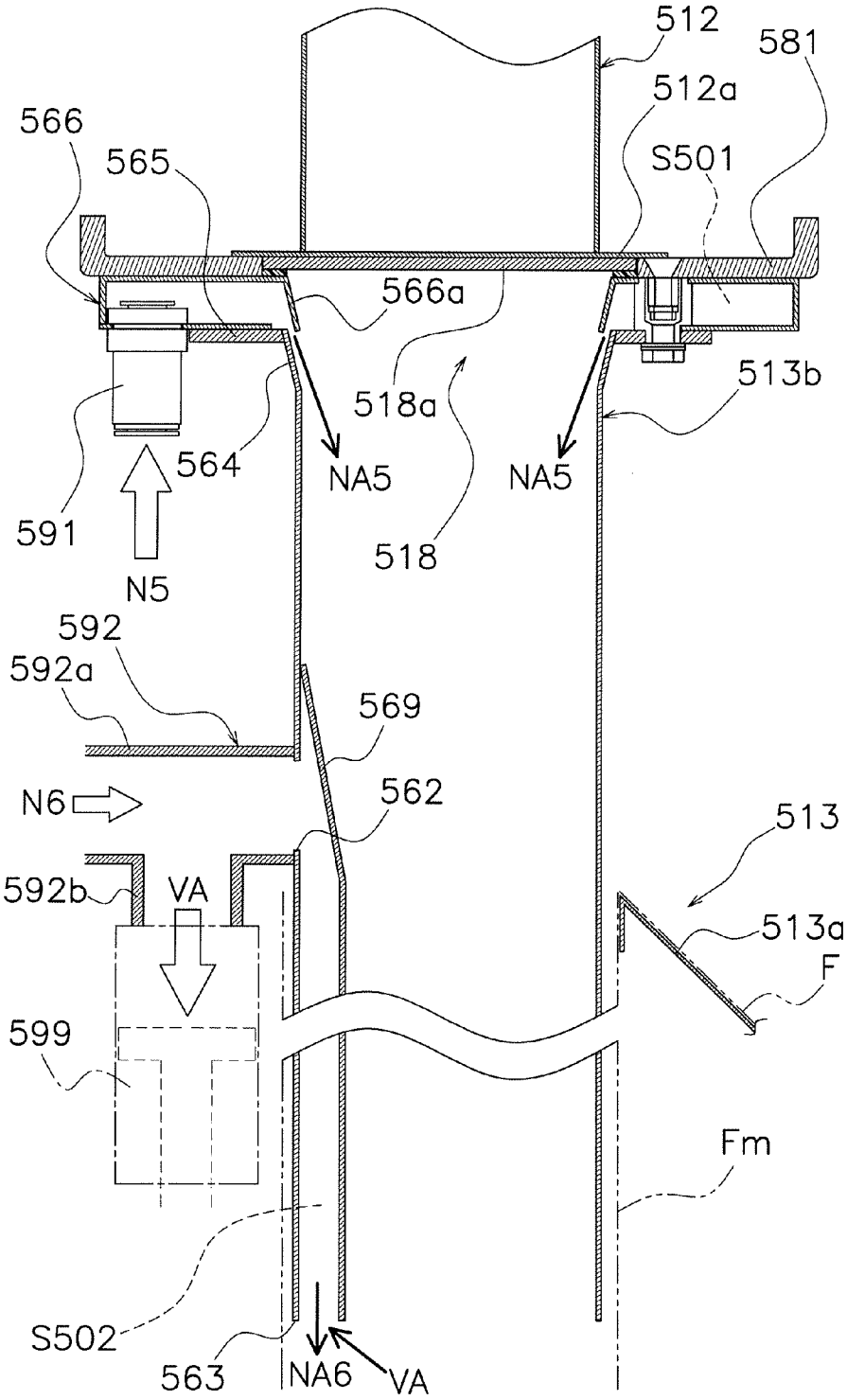
FIG. 15 is a drawing illustrating a shaping mechanism, nitrogen supply mechanism, and suction device of a form-fill-seal machine according to a fifth embodiment.

The first embodiment described above is configured such that when the tubular film Fm is squeezed mainly at the portion being laterally sealed, and the pressure in the space around the circumference of the packaged articles C2 increases immediately before the initiation of welding in which heat and pressure are made to act on the tubular film Fm, air escapes outward through the circular clearance between the tubular film Fm and the lower tube 13*b*, but the fifth embodiment is provided with a suction device 599 illustrated in FIG. 15 and employs a configuration in which gaseous material is forcibly suctioned out immediately before the initiation of welding in which heat and pressure are made to act on the tubular film Fm.

The fifth embodiment is the same as the third embodiment described above in that a bag is made by sealing laterally in the state in which the air inside the tubular film Fm has been replaced with an inert gas in order to prevent the packaged articles from becoming oxidized or from degenerating.

Figure 16:
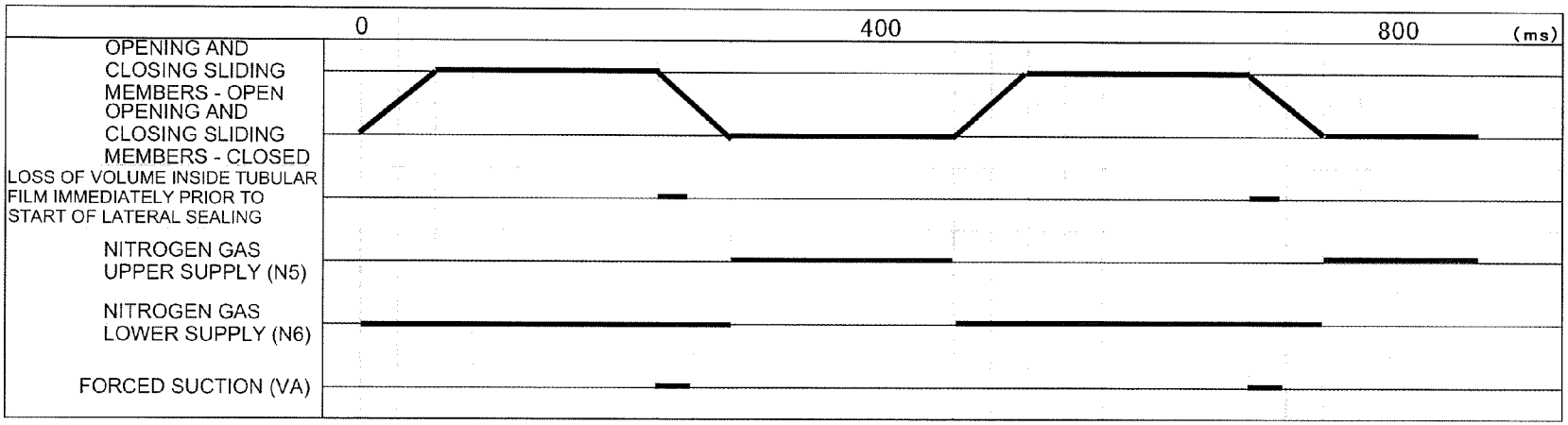
FIG. 16 is a timing chart of the nitrogen supply, the suction operation, and the opening and closing of an opening and closing sliding member of the fifth embodiment.

The following provides a description of the form-fill-seal machine according to the fifth embodiment, with reference to FIGS. 15 and 16.

Instead of the shaping mechanism 13 and the shutter mechanism 18 of the form-fill-seal machine according to the first embodiment, the form-fill-seal machine according to the fifth embodiment employs a shaping mechanism 513 and a shutter mechanism 518, which are illustrated in FIG. 15, and further adds the suction device 599 and a structure adapted to supply nitrogen gas to the interior space of the lower tube 513*b* and the interior space of the tubular film Fm. The configuration of the form-fill-seal machine according to the fifth embodiment is otherwise similar to the first embodiment described above.

The Shaping Mechanism 513

The shaping mechanism 513 has a former 513*a* and a lower tube 513*b*.

The former 513*a* is disposed so as to surround the lower tube 513*b*, and has the same shape as the former 13*a* described above. A sheet of the film F is fashioned into a tube upon passing between the former 513*a* and the lower tube 513*b*, thus becoming the tubular film Fm.

The lower tube 513*b* is a substantially round member, the upper and lower ends of which are open. The upper part of the lower tube 513*b* comprises a hollow circular member 566 forming an opening at the upper end, a different-diameter pipe part 564 positioned directly below the hollow circular member 566, and a flange member 565. The different-diameter pipe part 564, as illustrated in FIG. 15, has a greater diameter at the upper end than the diameter at the lower end. The inner peripheral edge of the flange member 565 is welded to the upper end of the different-diameter pipe part 564. A portion 566*a* forming the inner peripheral surface of the hollow circular member 566 has a greater diameter at the upper end than the diameter at the lower end, and has substantially the same shape as the different-diameter pipe part 564 (see FIG. 15). The hollow circular member 566 has a circular opening at the inner peripheral portion of the lower surface thereof. In a state of the hollow circular member 566 being affixed to the flange member 565, the nitrogen gas in the interior space of the hollow circular member 566 (described later) is sprayed downward through the opening thereof (see the arrows NA5 in FIG. 15). A nitrogen gas piping connection joint 591 is mounted onto the outer peripheral portion of the lower surface of the hollow circular member 566. The nitrogen gas piping connection joint 591 is connected to nitrogen gas piping extending from a nitrogen gas supply device (not shown). The interior space of the hollow circular member 566 acts as a nitrogen gas upper supply route 5501 adapted to supply nitrogen gas to the interior space of the lower tube 513*b*, and nitrogen gas N5 (see FIG. 15) flows in via the nitrogen gas piping connection joint 591.

When opening and closing sliding members 518*a* of the shutter mechanism 518 are in a closed state, the opening at the upper end of the hollow circular member 566 of the lower tube 513*b* is blocked by the opening and closing sliding members 518*a*.

A gaseous material flow path 5502 is formed at the lower end 563 of a side surface of the front surface of the lower tube 513*b*, from a position slightly lower than the upper part of the lower tube 513*b*. The gaseous material flow path S502 is formed by a sheet member 569. Nitrogen gas N6 (see FIG. 15) is supplied to the upper part of the gaseous material flow path 5502 via a T-shaped piping connection joint 592 and a round hole 562. The gaseous material inside the gaseous material flow path 5502 is forcibly suctioned out by the suction device 599 via the T-shaped piping connection joint 592 and the round hole 562 (see the arrow VA in FIG. 15).

A nitrogen gas supply connection unit 592*a* of the T-shaped piping connection joint 592 is connected to the nitrogen gas piping extending from the nitrogen gas supply device. The nitrogen gas supplied to the gaseous material flow path 5502 is sprayed into the interior space of the tubular film Fm from the opening at the lower part of the gaseous material flow path 5502 (see the arrow NA6 in FIG. 15).

The Suction Device 599

A gaseous material suction connection unit 592*b* of the T-shaped piping connection joint 592 is connected to the suction device 599. Herein, a cylinder, a piston, and an electric ball screw device for actuating the cylinder and the piston are employed as the suction device 599. The suction device 599 causes the piston, which is located near the gaseous material suction connection unit 592*b*, to move so as to retract from the gaseous material suction connection unit 592*b*, whereby the gaseous material in the gaseous material flow path S502 and the interior space of the tubular film Fm is suctioned out and housed in the interior space of the cylinder. The suction device 599 can conversely cause the piston to move so as to approach the gaseous material suction connection unit 592*b* to send the gaseous material inside the cylinder back into the interior space of the tubular film Fm, thus preparing for the next suction operation.

The Shutter Mechanism 518

The shutter mechanism 518 is a mechanism composed of the opening and closing sliding members 518*a*, which are positioned in the clearance in the height direction between the upper tube 512 and the lower tube 513*b*; and various parts adapted to guide or actuate the pair of sheet-shaped opening and closing sliding members 518*a*. The opening and closing sliding members 518*a* are guided and supported on fixed frames 581 of the shutter mechanism 518, and move horizontally in the left-right direction (in the direction orthogonal to the plane in FIG. 15). In the closed state of the opening and closing sliding members 518*a*, the round opening at the upper end of the hollow circular member 566 of the lower tube 513*b* is blocked, and almost no clearance remains between the upper end of the hollow circular member 566 of the lower tube 513*b* and the opening and closing sliding members 518*a*. A flange member 512*a* of the upper tube 512 resting on and affixed to the fixed frame 581 from above is positioned directly above the opening and closing sliding members 518*a*. The structure of the upper tube 512 is similar to that of the upper tube 12 of the first embodiment.

The various parts of the shutter mechanism 518 adapted to guide and actuate the opening and closing sliding members 518*a* are similar to those of the shutter mechanism 18 of the first embodiment, and therefore herein a description thereof has been omitted.

The Control Device

The control device has a similar configuration to that of the control device 90 of the first embodiment, and further controls the supply of the nitrogen gas N5 to the nitrogen gas upper supply route S501 via the nitrogen gas piping connection joint 591 as well as the supply of nitrogen gas N6 to the gaseous material flow path S502 via the T-shaped piping connection joint 592, by opening and closing an opening and closing valve provided to the nitrogen gas piping connected to the nitrogen gas piping connection joint 591 and an opening and closing valve provided to the nitrogen gas piping connected to the T-shaped piping connection joint 592.

The control device issues an actuation command to the electric ball screw device of the suction device 599 and causes the suction device 599 to perform the suction operation.

The control device controls the opening and closing operation of the opening and closing valves for nitrogen gas and the suction operation of the suction device 599 by linking the same to the opening and closing operation of the opening and closing sliding members 518*a* of the shutter mechanism 518.

FIG. 16 illustrates a timing chart for the command to open and the command to close the opening and closing sliding members 518*a* as well as the supply of the nitrogen gas N5 (which in the drawing is called the upper nitrogen gas supply) and the supply of the nitrogen gas N6 (which in the drawing is called the lower nitrogen gas supply), and the suction operation by the suction device 599 (which in the drawing is called the forced suction). The timing chart is one in which 130 bags are made per minute and the cycle to make one bag is 461 msec (0.461 seconds) long. Basically, when the opening and closing sliding members 518*a* are in the open state, the nitrogen gas is sprayed into the interior space of the tubular film Fm from the vicinity of the lower end 563 of the lower tube 513*b* via the gaseous material flow path 5502 (see the arrow NA6 in FIG. 15), and when the opening and closing sliding members 518*a* are in the closed state, the nitrogen gas is sprayed into the interior space of the lower tube 513*b* from the vicinity of the opening and closing sliding members 518*a* via the nitrogen gas upper supply route 5501 (see the arrow NA5 in FIG. 15).

The volume inside the tubular film Fm immediately prior to the start of lateral sealing illustrated in FIG. 16 rapidly decreases at the time immediately before the welding in which the lateral sealing mechanism 17 is used to cause heat and pressure to act on the tubular film Fm begins, i.e., at the time when the sealing jaws 51 are first brought into contact with the tubular film Fm, but herein the suction device 599 is made to perform the suction operation at such a time and forcibly suctions the gaseous material in the interior space of the tubular film Fm out via the gaseous material flow path 5502, thus allowing the gaseous material to escape outside the tubular film Fm (to the interior of the cylinder of the suction device 599). The rapid loss of volume inside the tubular film Fm immediately prior to the start of the lateral sealing is thereby substantially prevented from creating an upward airflow within the space inside the tubular film Fm above the sealing jaws 51.

Herein, the nitrogen gas N6 is continuously supplied to the gaseous material flow path 5502 also when the suction device 599 performs the suction operation, but the amount of gaseous material suctioned out per unit time is considerably greater than the amount of nitrogen gas N6 supplied per unit time, so an amount of gaseous material corresponding to the rapid loss of volume inside the tubular film Fm immediately prior to the start of the lateral sealing escapes through the gaseous material flow path S502 into the suction device 599 from the interior space of the tubular film Fm.

Though not explicitly shown in FIG. 16, the gaseous material that has been suctioned out and temporarily housed in the cylinder, including nitrogen gas, is returned to the interior space of the tubular film Fm via the gaseous material flow path S502 between the suction operation and the next suction operation of the suction device 599. The gaseous material-return operation of the suction device 599 is performed slowly when the opening and closing sliding members 518*a* are in the closed state.

Features of the Form-Fill-Seal Machine According to the Fifth Embodiment

Generally, the lateral sealing operation of the form-fill-seal machine includes an operation during which the laterally sealed portion of the tubular film is tucked in for heat and pressure to be applied to the tubular film. The present inventors have recently found through intensive study that during such an operation, there occurs a phenomenon in which the air present above the lateral sealing mechanism inside the tubular film flows upward as the tubular film is being squeezed. Then, particularly when a form-fill-seal is performed for packaged articles having a low specific gravity, such as a snack food, then the upward flow of air has come to be presumed to cause a disturbance to the state of a group of the packaged articles. That is, there occurs a phenomenon in which air inside the tubular film is blown upward immediately prior to the start of the welding in which the lateral sealing mechanism is used to cause heat and pressure to act on the tubular film. When such an upward blowing of air occurs, there is a risk that the packaged articles will be whirled up and the packaged articles will be caught in the laterally sealed portion, which causes poor sealing.

In particular when capacity is high (when there is a large number of bags produced per unit time), then above packaged articles that are to be laterally sealed, there are subsequently dropped packaged articles which are to be laterally sealed next, and it is critical to prevent the phenomenon in which the packaged articles whirl upward, in order to maintain the high capacity.

As a method for preventing the upward whirling phenomenon, it is effective to deploy a shutter mechanism 18, as in the form-fill-seal machine according to the first embodiment described above, but instead of such a configuration or alternatively in addition thereto, it is preferred to deploy the suction device 599 of the fifth embodiment described above.

(1)

The form-fill-seal machine according to the fifth embodiment deploys the suction device 599 for performing a suction operation. The suction operation of the suction device 599 is an operation for forcibly causing gaseous material to escape by actuation of a piston to the exterior of the tubular film Fm from the interior space of the tubular film Fm, which has been wound around the circumference of the lower tube 513*b*. The control device, as illustrated in FIG. 16, causes the suction device 599 to perform the suction operation at a time immediately prior to the start of the welding in which the lateral sealing mechanism 17 is used to cause heat and pressure to act on the tubular film Fm, i.e., at a time when the sealing jaws 51 are first brought into contact with the tubular film Fm. Surplus gaseous material equal to the rapid reduction in volume inside the tubular film Fm is suctioned into and housed in the suction device 599 immediately prior to the start of the lateral sealing, rather than being blown upward through the interior space of the tubular film Fm.

Accordingly, the form-fill-seal machine according to the fifth embodiment prevents the packaged articles from whirling upward in the interior space of the tubular film Fm wound around the circumference of the lower tube 513*b*, even in a case of packaging packaged articles having a low specific gravity, such as a snack food.

(2)

In the form-fill-seal machine according to the fifth embodiment, as illustrated in FIG. 16, the sealing jaws 51 are brought into contact with the tubular film Fm for the first time and the volume inside the tubular film Fm is rapidly reduced before the opening and closing sliding members 518*a* are closed. Therefore, it might be said that in the absence of the suction device 599, there is presented a risk that an upward airflow will occur in the interior spaces of the lower tube 513*b* and/or the upper tube 512 and that the packaged articles will whirl upward.

However, the suction device 599 described above is used to perform the forced suction operation of gaseous material and the gaseous material is allowed to escape out of the tubular film Fm from the interior space of the tubular film Fm, so the phenomenon in which the packaged articles whirl upward is prevented and consequently defects such as when the packaged articles catch in the laterally sealed portions are suppressed.

(3)

In the form-fill-seal machine according to the fifth embodiment, the gaseous material flow path S502 adapted to supply an inert gas to the interior space of the tubular film Fm from the lower end 563 of the lower tube 513*b* serves a dual purpose as a gaseous material flow path adapted for the suction operation of the suction device 599 for allowing gaseous material to escape out of the tubular film Fm from the interior space of the tubular film Fm. Therefore, within the lower tube 513*b*, the main space into which the packaged articles are dropped, excepting the gaseous material flow path S502, can be greatly ensured.

Modification Example of the Fifth Embodiment (A)

In the fifth embodiment described above, the shutter mechanism 518 and the suction device 599 both being deployed, gaseous material is prevented from rising to the interior space of the upper tube 512 from the interior space of the lower tube 513*b* by virtue of the round opening at the upper end of the hollow circular member 566 of the lower tube 513*b* being blocked by the opening and closing sliding members 518*a*, and also the suction device 599 is made to perform a suction operation, in view of the occurrence of the rapid loss of volume inside the tubular film Fm immediately before the start of the lateral sealing, before the opening and closing sliding members 518 are closed.

However, provided that the suction operation of the suction device 599 necessarily is possible at the time immediately prior to the start of the lateral sealing, the shutter mechanism 518 may be abandoned and the phenomenon in which the packaged articles whirl upward may be suppressed merely with the suction device 599.

(B)

In the fifth embodiment described above, the gaseous material flow path 5502 adapted to supply an inert gas to the interior space of the tubular film Fm from the lower end 563 of the lower tube 513*b* serves a dual purpose as a gaseous material flow path adapted for the suction operation of the suction device 599.

However, the suction device 599 can also be deployed in the form-fill-seal machine having no function for supplying nitrogen gas, argon gas, or other inert gas into the tubular film Fm, the suction operation of the suction device 599 then being used to prevent the phenomenon in which the packaged articles whirl upward.

(C)

In the fifth embodiment described above, the suction device 599 deployed has a cylinder, a piston, and an electric ball screw device for actuating the piston, but instead it is also possible to employ, as the suction device, an air-discharging device using an air blaster such as a fan or a blower.

REFERENCE SIGNS LIST

3: Form-fill-seal machine
11: Funnel member
12, 312, 412: Upper tube (First cylindrical member)
13*a*, 113*a*, 313*a*: Former (Shaping member)
3*b*, 113*b*, 213*b*, 313*b*, 413*b*: Lower tube (Second cylindrical member)
17: Lateral sealing mechanism
18: Shutter mechanism
18*a*, 318*a*, 418*a*: Opening and closing sliding members
51: Sealing jaws
90: Control device
161: Groove
161*a*: Depressed surface of the groove
391 Nitrogen gas piping connection joint (First gas supply unit)
392 Nitrogen gas piping connection joint (Second gas supply unit)
399 Packing (Sealing member)
493 Nitrogen gas piping connection joint (Third gas supply unit)
494 Nitrogen gas piping connection joint (Fourth gas supply unit)
599: Suction device B: Bag
B1: Lower sealing part
B2: Upper sealing part
EA: Air-discharging passage
F: Sheet film
Fm: Tubular film
N1, N2, N3, N4, N5, N6: Nitrogen gas (Inert gas)

What is claimed is:

1. A form-fill-seal machine for laterally sealing a tubular packaging material, whereby a bag is formed from the tubular packaging material and is filled with a packaged article dropped in from above, the form-fill-seal machine comprising:

a first cylindrical member including interior dimensioned for passage of the packaged articles dropped in from above;

a second cylindrical member located below the first cylindrical member such that the packaged article dropped through the interior of the first cylindrical member passes through an interior of the second cylindrical member;

a shaping member for winding a sheet of packaging material around an outer circumference of the second cylindrical member, and causing the packaging material to deform into the tubular packaging material;

a lateral sealing mechanism for laterally sealing the tubular packaging material to form a lower sealing part and an upper sealing part of the bag, the lateral sealing mechanism located below the second cylindrical member;

an opening and closing member disposed between the first cylindrical member and the second cylindrical member and adapted to shut off an upwardly oriented flow of air through the interior of the second cylindrical member when the opening and closing member is in a closed state; and a control device for controlling movements of the lateral sealing mechanism and the opening and closing member such that when the opening and closing member is in the closed state, a first packaged article is located within a first bag on which the upper sealing part is formed a second packaged article that follows the first packaged article is located inside the tubular packaging material on which the second lower sealing part is formed above the first bag, and a third packaged article that follows the second packaged article is located in the interior of the first cylindrical member above the opening and closing member.

2. The form-fill-seal machine according to claim 1, wherein the size of a clearance in the height direction between the first cylindrical member and the second cylindrical member is 20% or less of the interior diameter of the first cylindrical member; and the opening and closing member slides in a horizontal direction or in a substantially horizontal direction, thereby moving between an open state and the closed state.

3. The form-fill-seal machine according to claim 1, wherein the first cylindrical member and the second cylindrical member have substantially equivalent inside diameters, the inside diameter of the second cylindrical member being in a range of 90% to 110% of the interior diameter of the first cylindrical member.

4. The form-fill-seal machine according to claim 1, wherein the control device links the movement of the lateral sealing mechanism and the movement of the opening and closing member, such that the opening and closing member is moved to the closed state before the lateral sealing mechanism applies heat and pressure to the tubular packaging material to form at least one of the upper and lower sealing part, and the control device returns the opening and closing member to the open state at a predetermined time after the applying heat and pressure to the tubular packaging material by the lateral sealing mechanism.

5. The form-fill-seal machine according to claim 1, wherein the opening and closing member blocks an opening at an upper end of the second cylindrical member when in the closed state.

6. The form-fill-seal machine according to claim 5, further comprising a sealing member disposed between the second cylindrical member and the opening and closing member and adapted to prevent gaseous material in an interior of the second cylindrical member from leaking outward from a clearance in the height direction between the upper end of the second cylindrical member and the opening and closing member, when the opening and closing member is in the closed state.

7. The form-fill-seal machine according to claim 1, wherein an air-discharging passage adapted to allow gaseous material to escape to spaces outside and above the tubular packaging material from an interior of the tubular packaging material is formed between an outer surface of the second cylindrical member and the tubular packaging material wound around the circumference of the second cylindrical member; and the air-discharging passage extends upward from a position proximate the lower part of the second cylindrical member up to a position above the shaping member.

8. The form-fill-seal machine according to claim 7, wherein an inwardly recessed groove is formed on the second cylindrical member, the inwardly recessed groove extending from a lower part thereof to a position above the shaping member; and the air-discharging passage includes a space between a depressed surface of the groove and the tubular packaging material.

9. The form-fill-seal machine according to claim 1, comprising a first gas supply unit for supplying an inert gas to the interior of the second cylindrical member from a vicinity of the opening and closing member.

10. The form-fill-seal machine according to claim 9, further comprising a second gas supply unit for supplying an inert gas to the interior space of the tubular packaging material from a vicinity of the lower part of the second cylindrical member, wherein:

the control device further controls gas supply operations of the first gas supply unit and the second gas supply unit, and causes an inert gas to be supplied to the interior space of the second cylindrical member by the first gas supply unit when the opening and closing member is in the closed state.

11. The form-fill-seal machine according to claim 9, wherein the control device is configured to further control the first gas supply unit and the opening and closing member in such a manner that an inert gas is supplied to the interior space of the second cylindrical member by the first gas supply unit when the opening and closing member is in the closed state.

12. The form-fill-seal machine according to claim 11, further comprising a second gas supply unit for supplying an inert gas to the interior space of the tubular packaging material from a vicinity of the lower part of the second cylindrical member.

13. The form-fill-seal machine according to claim 1, further comprising a third gas supply unit for supplying an inert gas to the interior space of the tubular packaging material; and a fourth gas supplying unit for supplying an inert gas to the interior space of the first cylindrical member when the opening and closing member is in the closed state.

14. The form-fill-seal machine according to claim 1, further comprising a suction device for performing a suction operation to allow gaseous material to escape outside the tubular packaging material from the interior space of the tubular packaging material wound around the circumference of the second cylindrical member, wherein:

the control device links the movement of the lateral sealing mechanism and the suction operation of the suction device, and causes the suction device to perform the suction operation immediately before initialization of the lateral sealing mechanism to heat and apply pressure to the tubular packaging material.

15. The form-fill-seal machine according to claim 14, wherein the control device links the movement of the lateral sealing mechanism, the movement of the opening and closing member, and the suction operation of the suction device; and, immediately before initiation of the lateral sealing mechanism to cause heat and pressure to act on the tubular packaging material, the control device issues a command causing the opening and closing member to transition from the open state to the closed state and causes the suction device to perform the suction operation.

16. The form-fill-seal machine according to claim 14, further comprising a gas supply unit for supplying an inert gas to the interior space of the tubular packaging material from the vicinity of the lower part of the second cylindrical member, wherein:

the interior space of the second cylindrical member is divided into a primary space into which the packaged article is dropped and a secondary space partitioned from the primary space; and the secondary space has a dual purpose as a suction flow path for gaseous material to the suction device during the suction operation and as a supply flow path of the inert gas from the gas supply unit.

17. The form-fill-seal machine according to claim 1, wherein a gap is defined between the first cylindrical member and the second cylindrical member and is arranged such that the article to be packed can substantially straightforwardly drop from the first cylindrical member into the second cylindrical member.

* * * * *